US010514651B1

(12) United States Patent
Watanabe et al.

(10) Patent No.: US 10,514,651 B1
(45) Date of Patent: Dec. 24, 2019

(54) CLEANING BLADE, CLEANING DEVICE, IMAGE FORMING APPARATUS, AND PROCESS CARTRIDGE

(71) Applicants: Kazuhiko Watanabe, Tokyo (JP); Hiroshi Nakai, Kanagawa (JP); Hiroshi Mizusawa, Tokyo (JP); Tomoyuki Kirigane, Kanagawa (JP); Yasuhide Nakazawa, Kanagawa (JP)

(72) Inventors: Kazuhiko Watanabe, Tokyo (JP); Hiroshi Nakai, Kanagawa (JP); Hiroshi Mizusawa, Tokyo (JP); Tomoyuki Kirigane, Kanagawa (JP); Yasuhide Nakazawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/507,235

(22) Filed: Jul. 10, 2019

(30) Foreign Application Priority Data

Jul. 26, 2018 (JP) ..... 2018-140073
Jul. 31, 2018 (JP) ..... 2018-144149

(51) Int. Cl.
*G03G 21/00* (2006.01)
*G03G 21/18* (2006.01)

(52) U.S. Cl.
CPC ..... *G03G 21/0017* (2013.01); *G03G 21/0076* (2013.01); *G03G 21/1814* (2013.01)

(58) Field of Classification Search
None
See application file for complete search history.

(56) References Cited

U.S. PATENT DOCUMENTS

2001/0038764 A1* 11/2001 Kubo ..... G03G 9/0827 399/350
2004/0141779 A1* 7/2004 Yanagida ..... G03G 21/1814 399/350
2010/0008707 A1* 1/2010 Sako ..... B29C 39/025 399/350
2010/0031466 A1* 2/2010 Abe ..... G03G 21/0017 15/256.5
2011/0229188 A1* 9/2011 Watanabe ..... G03G 15/161 399/101
2011/0229233 A1* 9/2011 Watanabe ..... G03G 21/0017 399/350
2015/0331383 A1* 11/2015 Takahashi ..... G03G 21/0011 399/71
2017/0227922 A1 8/2017 Takami et al.
2017/0300002 A1* 10/2017 Imanaka ..... G03G 5/05
2017/0363987 A1 12/2017 Nodera et al.
(Continued)

FOREIGN PATENT DOCUMENTS

JP 2003-058009 2/2003
JP 2003-241599 8/2003
(Continued)

OTHER PUBLICATIONS

Asker, "What is a duronneter?", (2019).*

*Primary Examiner* — Sevan A Aydin
(74) *Attorney, Agent, or Firm* — Oblon, McClelland, Maier & Neustadt, L.L.P.

(57) ABSTRACT

A cleaning blade includes an edge portion made of an elastic material having a rebound resilience value R35 at 35° C. and a 100% modulus value M35 at 35° C. that satisfy the relation R35≤−4.8 M35+42.

20 Claims, 12 Drawing Sheets

(56) References Cited

U.S. PATENT DOCUMENTS

| | | | |
|---|---|---|---|
| 2018/0120737 | A1 | 5/2018 | Okamoto et al. |
| 2018/0329358 | A1 | 11/2018 | Takami et al. |
| 2018/0348698 | A1 | 12/2018 | Tamaki et al. |
| 2019/0064699 | A1 | 2/2019 | Nodera et al. |

FOREIGN PATENT DOCUMENTS

| | | |
|---|---|---|
| JP | 2003-334292 | 11/2003 |
| JP | 2004-220018 | 8/2004 |
| JP | 2007-057918 | 3/2007 |
| JP | 2008-053398 | 3/2008 |
| JP | 2008-139744 | 6/2008 |
| JP | 2008-233120 | 10/2008 |
| JP | 2011-197309 | 10/2011 |

* cited by examiner

—⊖—: NINTH EXAMPLE
·····⊖·····: ELEVENTH EXAMPLE
- - -⊖- - -: FIFTEENTH EXAMPLE
- · -⊖- · -: EIGHTEENTH EXAMPLE
—⊟—: TWELFTH EXAMPLE
·····⊟·····: TWENTY FIRST EXAMPLE
- - -⊟- - -: TWENTY SECOND EXAMPLE
- · -⊟- · -: TWENTY THIRD EXAMPLE
—△—: TWENTY FOURTH EXAMPLE
·····△·····: TWENTY FIFTH EXAMPLE

CLEANING BLADE, CLEANING DEVICE, IMAGE FORMING APPARATUS, AND PROCESS CARTRIDGE

CROSS-REFERENCE TO RELATED APPLICATIONS

This patent application is based on and claims priority pursuant to 35 U.S.C. § 119 to Japanese Patent Applications No. 2018-140073, filed on Jul. 26, 2018 and No. 2018-144149, filed on Jul. 31, 2018 in the Japanese Patent Office, the entire disclosure of which are hereby incorporated by reference herein.

BACKGROUND

Technical Field

Embodiments of the present disclosure generally relate to a cleaning blade, and a cleaning device that includes the cleaning blade, a process cartridge, and an image forming apparatus incorporating the cleaning device and the process cartridge, such as a copier, a printer, a facsimile machine, or a multifunction peripheral having at least two of copying, printing, facsimile transmission, plotting, and scanning capabilities.

Background Art

Image forming apparatuses include a cleaning blade having a blade member made of elastic material. An edge portion of the cleaning blade contacts a surface of an object to be cleaned that moves in contact with the edge portion and removes substances adhering to the surface of the object.

SUMMARY

This specification describes an improved cleaning blade that includes an edge portion made of an elastic material having a rebound resilience value R35 at 35° C. and a 100% modulus value M35 at 35° C. that satisfy the following relation:

$$R35 \leq -4.8M35+42.$$

This specification further describes an improved cleaning blade having an edge portion made of an elastic material having a rebound resilience value R35 at 35° C. and a JIS Asker A hardness value H35 at 35° C. that satisfy the following relation:

$$R35 \leq -1.56 \times H35+132.$$

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
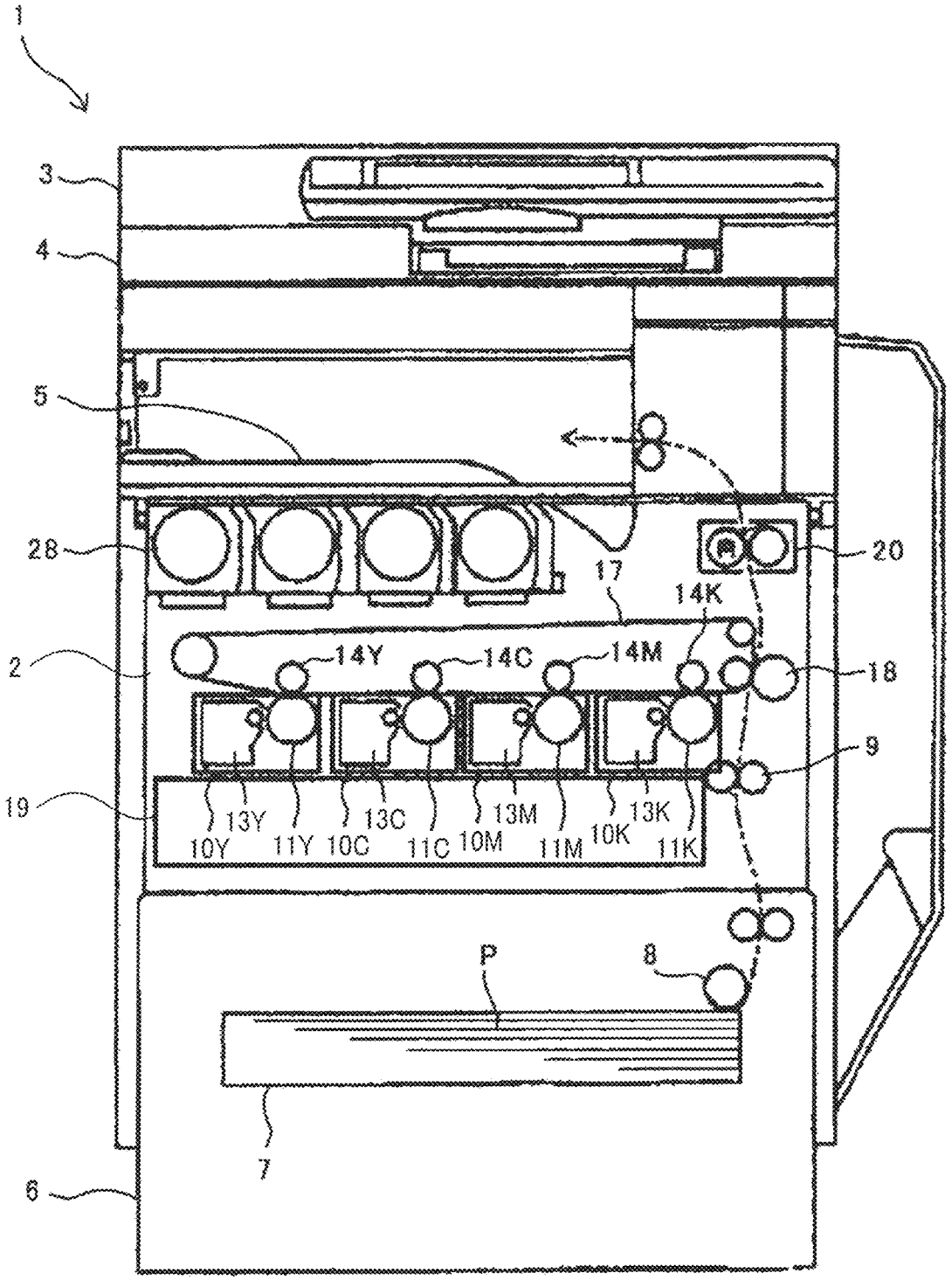
FIG. 1 is a schematic configuration diagram illustrating an image forming apparatus according to present embodiments.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference numbers are allocated to elements having the same function or shape and redundant descriptions thereof are omitted below.

Descriptions are given below of an embodiment in which a cleaning device according to the present disclosure is set in a tandem-type full-color image forming apparatus using an intermediate transfer method (hereinafter, simply called "the image forming apparatus").

FIG. 1 is a schematic configuration diagram illustrating the image forming apparatus 1 according to the present embodiment. With reference to FIG. 1, a schematic configuration of the image forming apparatus 1 is described. The image forming apparatus 1 includes an automatic document feeder (ADF) 3 and a document reader 4 from the top of the main body. Below the document reader 4, the image forming apparatus 1 includes a stack unit 5 to stack a recording sheet P as a recording medium on which an image has been formed. Under the stack unit 5, the image forming apparatus 1 includes an image forming section 2 to form an image based on a document image read by the document reader 4 and a sheet feeder 6 to feed the recording sheet P to the image forming section 2.

The automatic document feeder (ADF) 3 separates the document one by one from a document bundle and automatically feeds the document onto a contact glass of the document reader 4, and the document reader 4 reads the document fed onto the contact glass.

The image forming section 2 includes an intermediate transfer belt 17 that is taut around a plurality of support rollers and rotates counterclockwise in FIG. 1. Additionally, on the underside of the intermediate transfer belt 17, image forming units 10Y, 10C, 10M, and 10K are arranged in parallel and form yellow, cyan, magenta, and black toner images, respectively. The image forming units 10Y, 10C, 10M, and 10K includes photoconductors 11Y, 11C, 11M, and 11K, respectively, to form each color toner image. Around each of the photoconductors 11Y, 11C, 11M, and 11K, a charger, each of developing devices 13Y, 13C, 13M, and 13K, and a photoconductor cleaning device are disposed, respectively.

The image forming section 2 includes primary transfer rollers 14Y, 14C, 14M, and 14K that contact the inner circumferential surface of the intermediate transfer belt 17 opposite the photoconductors 11Y, 11C, 11M, and 11K. Additionally, the image forming section 2 includes a secondary transfer roller 18 that contacts an outer circumferential surface of the intermediate transfer belt 17 on the downstream side of the primary transfer rollers 14Y, 14C, 14M, and 14K in a surface movement direction of the intermediate transfer belt 17. In addition, the image forming section 2 includes a belt cleaner that contacts an outer circumferential surface of the intermediate transfer belt 17 on the downstream side of the secondary transfer roller 18 in the surface movement direction of the intermediate transfer belt 17. Above the secondary transfer roller 18, a fixing device 20 is disposed.

Below the image forming units 10Y, 10C, 10M, and 10K, the image forming section 2 includes an optical writing unit 19 to emit laser light to the photoconductors 11Y, 11C, 11M, and 11K. Additionally, a toner supply device 28 is disposed above the intermediate transfer belt 17. The toner supply device 28 includes four toner cartridges (toner containers) that correspond to yellow, cyan, magenta, and black colors and are removably installed in the toner supply device 28. That is, the toner cartridges are replaceable. Other portions of the toner supply device 28 than the toner cartridges function as toner conveyance devices to transport toner supplied from the toner cartridges to the developing devices 13Y, 13C, 13M, and 13K.

The sheet feeder 6 includes a sheet tray 7 to store a plurality of stacked recording sheets P and a feed roller 8 to feed a recording sheet P on the top of the plurality of stacked recording sheets P to the image forming section 2.

Image forming processes performed by the above-described image forming apparatus 1 are described.

Each of image forming units 10Y, 10C, 10M, and 10K forms each color toner image. Firstly, each of the photoconductors 11Y, 11C, 11M, and 11K rotates, and the charger uniformly charges a surface of each of the photoconductors 11Y, 11C, 11M, and 11K. Subsequently, the optical writing unit 19 emits the laser light to the surface of each of the photoconductors 11Y, 11C, 11M, and 11K to form electrostatic latent images on the photoconductors based on color separation image data generated from document image data read by the document reader 4. After that, each of the developing devices 13Y, 13C, 13M, and 13K adheres toner onto each of the electrostatic latent images to form a visible color toner image on each of the photoconductors 11Y, 11C, 11M, and 11K.

The primary transfer rollers 14Y, 14C, 14M, and 14K sequentially transfer each of the color toner images on each of the photoconductors 11Y, 11C, 11M, and 11K onto the intermediate transfer belt 17 to form a superimposed color toner image on the intermediate transfer belt 17. After transfer of the color toner images onto the intermediate transfer belt 17, each of the photoconductor cleaning devices 15Y, 15C, 15M, and 15K cleans the surface of each of the photoconductors 11Y, 11C, 11M, and 11K by removing residual toner remaining on the surface of the photoconductors to be ready for a subsequent image forming operation.

On the other hand, in the sheet feeder 6, the recording sheets P stored in the sheet tray 7 are separated one by one, and the feed roller 8 feeds the separated recording sheet P to the image forming section 2. The recording sheet P contacts the registration rollers 9 and stops. In synchronization with timing of toner image formation in the image forming section 2, the registration rollers 9 convey the recording sheet P contacted and stopped at the registration rollers 9 to a secondary transfer area between the intermediate transfer belt 17 and the secondary transfer roller 18. In the secondary transfer area, the secondary transfer roller 18 transfers the superimposed color toner image on the intermediate transfer belt 17 onto the recording sheet P conveyed by the registration roller 9. The superimposed color toner image transferred onto the recording sheet P is fixed by the fixing device 20 and ejected to the stack unit 5. After transfer of the superimposed color toner image onto the sheet, the belt cleaner cleans the surface of the intermediate transfer belt 17 by removing residual toner remaining on the surface of the intermediate transfer belt 17 to be ready for a subsequent image forming operation.

In the present embodiment, each of the image forming units 10Y, 10C, 10M, and 10K is configured as a process cartridge that is integrally and removably attached to the image forming apparatus body and includes each of the photoconductors 11Y, 11C, 11M, and 11K, the charger, each of the developing devices 13Y, 13C, 13M, and 13K, and the photoconductor cleaning device, which are supported by a common frame. The configuration as the process cartridge improves the workability for maintenance.

Figure 2:
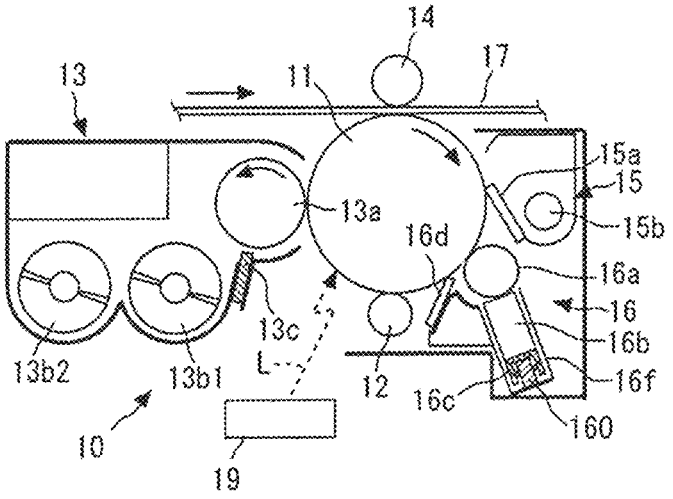
FIG. 2 is a schematic configuration diagram illustrating an image forming unit of the image forming apparatus.

FIG. 2 is a schematic configuration diagram illustrating the image forming units 10Y, 10C, 10M, and 10K. The four image forming units 10Y, 10C, 10M, and 10K have a similar configuration except the color of the toner used in the image forming processes. Therefore, the process cartridge, the developing devices, and the toner supply device are illustrated without suffixes Y, M, C, and K, which denote the color of the toner, in the drawings.

As illustrated in FIG. 2, the image forming unit 10 includes the photoconductor 11 as an image bearer, the charger 12 including a charging roller to charge the photoconductor 11, the developing device 13 to develop the electrostatic latent image formed on the photoconductor 11, the photoconductor cleaning device 15 to collect untransferred toner from the photoconductor 11, and a lubricant applying device 16 to apply lubricants to the photoconductor 11, which are integrally accommodated in a case and configured as the process cartridge.

The charger 12 is disposed opposite the surface of the photoconductor 11 and mainly configured by the charging roller to which a charging voltage is applied.

The developing device 13 mainly includes a developing roller 13*a* as a developer bearer to bear developer on a surface of the developer bearer, a stirring screw 13*b*2 to stir and convey the developer stored in a developer container, a supply screw 13*b*1 to supply the stirred developer to the developing roller 13*a* and convey the developer, and a developing blade 13*c* opposite the developing roller 13*a* to adjust the amount of developer on a surface of the developing roller 13*a*. In the developing device 13, the stirring screw 13*b*2 stirs and conveys the developer stored in the developer container, and the supply screw 13*b*1 conveys the developer while supplying the stirred developer to the developing roller 13*a*. The developing roller 13*a* supplies toner to the surface of the photoconductor 11 to develop the electrostatic latent image formed thereon.

The photoconductor cleaning device 15 as a cleaning device includes a cleaning blade 15*a*. The cleaning blade 15*a* is made of an elastic material such as urethane rubber, in one layer or two layers. A front edge portion of the cleaning blade 15*a* in a photoconductor side contacts the surface of the photoconductor 11 and cleans the surface of the photoconductor 11. Substances adhering on the photoconductor 11, such as residual toner and the like, are removed by the cleaning blade 15*a*, fall onto the photoconductor cleaning device 15, and are conveyed to a waste toner collection container by a conveyance coil 15*b* disposed in the photoconductor cleaning device 15. A detailed description of the cleaning blade 15*a* is described later.

The lubricant applying device 16 includes a blade 16*d*, a solid lubricant 16*b*, a lubricant supply roller 16*a* to slide on the photoconductor 11 and the solid lubricant 16*b*, a holder 16*c* to hold the solid lubricant 16*b*, a case 16*f* to store the holder 16*c* together with the solid lubricant 16*b*, and a pressing device 160 to press the holder 16*c*, together with the solid lubricant 16*b*, to the lubricant supply roller 16*a*.

The case 16*f* has a substantially box shape that houses the holder 16*c* together with the solid lubricant 16*b* so that the solid lubricant 16*b* can move in a direction in which the solid lubricant 16*b* presses against the lubricant supply roller 16*a*, that is, the movement of the solid lubricant 16*b* is not interrupted. In the case 16*f*, a gap between the solid lubricant 16*b* and the holder 16*c* is set to be relatively small, within a range that does not interrupt the movement of the solid lubricant 16*b* and the holder 16*c* in a pressing direction, that is, the direction in which the solid lubricant 16*b* presses against the lubricant supply roller 16*a*, which prevents the solid lubricant 16*b* from being inclined and pressed against the lubricant supply roller 16*a* to some extent.

The lubricant supply roller 16*a* is driven and rotated by a drive motor and contacts and rubs the rotating photoconductor 11 with a linear speed difference. In addition, the lubricant supply roller 16*a* is disposed to contact and slide the solid lubricant 16*b* and the photoconductor 11. Rotation of the lubricant supply roller 16*a* scrapes lubricants from the solid lubricant 16*b*, bring the lubricants to an applying position in which the scraped lubricants are applied onto the photoconductor 11, and applies the lubricants onto the photoconductor 11.

An amount of the lubricant to be applied (supplied) to the photoconductor 11 is adjusted so that a friction coefficient (a dynamic friction coefficient) between the photoconductor 11 and the cleaning blade 15*a* is 0.2 or less. Adjusting a rotational speed of the lubricant supply roller 16*a* enables adjusting the amount of the lubricants to be applied (supplied) to the photoconductor 11.

The lubricant supply roller 16*a* may be a brush-like member or a foam roller. Preferably, the lubricant supply roller 16*a* is a foam roller. The foam roller includes a core and a foam layer containing multiple cells formed on the outer peripheral surface of the core as a bare minimum, and may additionally include other members if necessary. Material, shape, size, and structure of the core are not limited and may be appropriately selected based on the core. For example, the core may be made of resins such as epoxy resin and phenol resin; or metals such as iron, aluminum and stainless steel. The core may be a solid or hollow cylinder in shape. The core may have an adhesive layer on the surface thereof.

The foam layer is formed on the outer peripheral surface of the core and contains multiple cells (sometimes referred to as "pores" or "voids"). The shape of the foam layer is not limited and may be selected based on needs thereof, for example, may be cylinder hollow. The material of the foam layer is not limited and may be selected based on needs thereof, for example, may be foamed polyurethane. The lubricant supply roller 16*a* may be the brush-like member, but the foam roller can improve protection performance about the image bearer because the foam roller can more uniformly supply the lubricants onto the image bearer than the brush-like member. The foam roller also solves the problem of the brush-like member that the scraped amount of the lubricants fluctuates with deterioration of the brush. The foamed polyurethane may be produced by any known production method. The foamed polyurethane may be produced from raw materials including a polyol, a polyisocyanate, a catalyst, a foaming agent, and a foam stabilizer.

The open-cell foam layer easily returns to the original shape when compressed, because a residual compression strain is small. Therefore, preferably, the open-cell foam layer is not almost deformed even after long-term use. In addition, compared to the closed-cell foam layer, the open-cell foam layer is less likely to cause scattering of the lubricants when slidably abrading the solid lubricant, which is advantageous in terms of cost.

Moreover, the open-cell foam layer can form a uniform protective layer on the image bearer with a small supply of the lubricants, which prevents the occurrence of filming on the image bearer. Thus, the lubricants can be formed into a small block and therefore the apparatus as a whole can be made compact.

The average cell diameter of the foam roller is equal to or less than the number-based median diameter (D50) of the lubricants. Preferably, the average cell diameter is in the range of from 400 μm to 850 μm, more preferably from 500 μm to 700 μm, for well grinding the solid lubricant and uniformly supplying the lubricants onto the surface of the image bearer. When the average cell diameter is 400 μm or more, it becomes much easier to grind the solid lubricant, making supply of the lubricants stable, in a case in which the solid lubricant is in the form of a molded block. When the average cell diameter is 850 m or less, the contact area between the lubricants and the image bearer is partially increased, making it much easier to uniformly supply the lubricants onto the image bearer.

The solid lubricant 16*b* is made by mixing inorganic lubricant and alumina into fatty acid metal zinc. As a preferable example of fatty acid metal zincs, the fatty acid metal zinc includes at least zinc stearate. The inorganic lubricant includes at least one of talc, mica, and boron nitride and is preferably the boron nitride.

Since boron nitride has almost no change in characteristics due to discharge, the use of solid lubricant 16*b* containing boron nitride prevents deterioration due to discharge from occurring even after a charging process and a transfer process that are performed on the photoconductor 11. In addition, the use of the solid lubricant 16*b* containing boron nitride can prevent the photoconductor 11 from being oxidized and evaporated by the discharge.

However, use of the lubricants consisting only of boron nitride may cause shortage of the lubricants to be supplied to the entire surface of the photoconductor 11, and a uniform lubricant film may not be formed on the entire surface of the photoconductor 11. Therefore, in addition to boron nitride, a fatty acid metal salt is blended in the solid lubricant 16*b*. This blend enables efficient formation of the lubricant film over the entire surface of the photoconductor 11 and maintaining high lubricity for a long time. As the fatty acid metal salt, for example, the following material may be used: lauroyl lysine, monocetyl phosphate sodium zinc salt, lauroyltaurine calcium, and fatty acid metal salt having a lamellar crystal structure such as fluororesin, zinc stearate, calcium stearate, barium stearate, aluminum stearate, and magnesium stearate. In particular, use of zinc stearate as the fatty acid metal salt improves the extensibility of the lubricants on the photoconductor 11 and lowers the hygroscopicity of the lubricants. As a result, the lubricity is less likely to be impaired even if the humidity changes.

Other than the fatty acid metal salts and the boron nitride, materials blended in the solid lubricant 16*b* may include external additives that may be gaseous materials or liquid materials such as silicone oil, fluorine oil, and natural wax.

The solid lubricant 16*b* including materials described above may be made by placing a powdery lubricant in a mold and applying pressure in the mold to form a solid bar, or by heating and melting the powdery lubricant, pouring the melted lubricant into the mold, and then cooling it to form a lubricant block. To form the solid bar as the solid lubricant 16*b* from the materials of the lubricants, binder may be added in the materials.

The blade 16*d* is made of a rubber material such as urethane rubber and is configured to contact the photoconductor 11 in a counter direction at a position downstream from the lubricant supply roller 16*a* in a rotational direction of the photoconductor 11. The blade 16*d*. mechanically scrapes off substances such as the untransferred toner adhering on the photoconductor 11.

In addition to the untransferred toner, the substances adhering on the photoconductor 11 include paper dust that comes from the recording sheet P, discharge products generated on the photoconductor 11 during discharge by the charger 12 additives to the toner.

By applying the solid lubricant 16*b* to the surface of the photoconductor 11 via the lubricant supply roller 16*a*, the lubricant is applied on the photoconductor 11 in powder form. Since such powder from the lubricant cannot fully achieve lubricity, the blade 16*d* that is a regulating blade functions as a member to regulate the powder lubricant into a sufficiently uniform layer.

After the blade 16*d* covers the powder lubricant and makes a lubricant film on the photoconductor 11, the lubricant can fully exert the lubricity. When the blade 16*d* covers the powder lubricant, the finer the powder lubricant applied by the lubricant supply roller 16*a* is, the thinner the film can be formed in a molecular-level by the blade 16*d*, and the blade 16*d* can make the lubricant supplied on the photoconductor 11 by the lubricant supply roller 16*a* to the thin film.

On a back of the solid lubricant 16*b*, the pressing device 160 is disposed so that the lubricant supply roller 16*a* uniformly contacts the solid lubricant 16*b*, supports the solid lubricant 16*b*, and presses the solid lubricant toward the lubricant supply roller 16*a*.

Figure 3A:
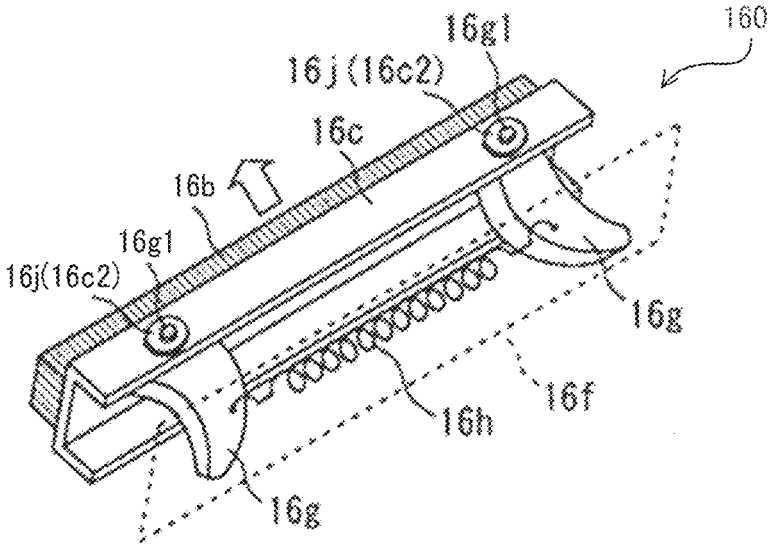
FIG. 3A is a perspective view illustrating a schematic configuration of a solid lubricant and a pressing mechanism in a pressing device of the image forming unit.
Figure 3B:
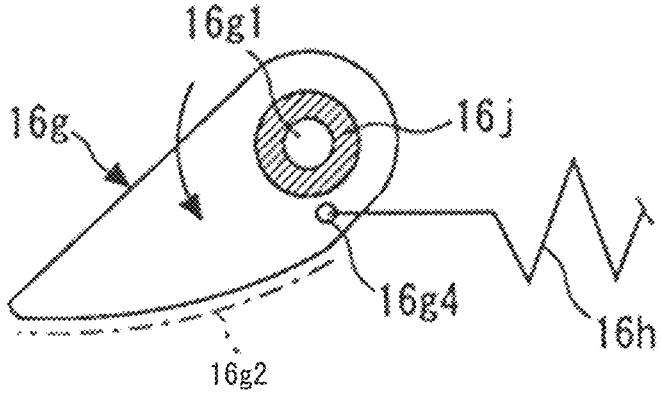
FIG. 3B is a schematic configuration diagram illustrating a rotation member in the pressing device.

FIGS. 3A and 3B illustrate a schematic configuration of the pressing device 160. FIG. 3A is a perspective view illustrating the solid lubricant 16*b* and the pressing device 160, and FIG. 3B is a schematic configuration diagram illustrating a retraction member 16*g*.

The pressing device 160 includes a holder 16*c* to hold the solid lubricant 16*b*, a pair of retraction members 16*g* retractably supported by the holder 16*c*, a tension spring 16*h* connected to the pair of retraction members 16*g*, and a bearing 16*j*.

The holder 16*c* retractably supports each of a pair of retraction members 16*g* as pressing members at distant positions in a direction of a rotation axis of the lubricant supply roller 16*a* that is a direction perpendicular to the sheet of FIG. 2. The pair of retraction members 16*g* are retracted in predetermined directions, respectively, by a biasing force of the tension spring 16*h* and indirectly press the solid lubricant 16*b* via the holder 16*c* to press the solid lubricant 16*b* against the lubricant supply roller 16*a*.

Specifically, a support shaft 16*g*1 as a shaft portion is formed on both sides of the retraction member 16*g*. The support shaft 16*g*1 is at a rotation center of retracting movement of the retraction member 16*g*. The support shaft 16*g*1 of the retraction member 16*g* is inserted into an inner race of the bearing 16*j* and fitted in the hole 16*c*2 of the holder 16*c* to retractably hold the retraction member 16*g* in the holder 16*c*. The two retraction members 16*g* are respectively arranged in the holder 16*c* to be bilaterally symmetrical in the direction of the rotation axis that is a width direction.

The pair of retraction members 16*g* is connected to the tension spring 16*h*. Specifically, as illustrated in FIG. 3B, hooks at both ends of the tension spring 16*h* are connected to the holes 16*g*4 of the retraction member 16*g*. The tension spring 16*h* pulls the pair of retraction members 16*g* to retract in different directions and press against the case 16*f* The tension spring 16*h* works as a biasing member that presses the holder 16*c* to the lubricant supply roller 16*a*. More specifically, the two retraction members 16*g* receive, from the tension spring 16*h*, a spring force (biasing force) in a direction in which cam-shaped portions 16*g*2 in contact with the inner wall of the case 16*f* approach each other. The spring force presses the retraction member 16*g* on the left side of FIG. 3A to rotate the retraction member 16*g* on the left side of FIG. 3A counterclockwise about the support shaft 16*g*1 as the rotation center. In contrast, the spring force presses the retraction member 16*g* on the right side of FIG. 3A to rotate the retraction member 16*g* on the right side of FIG. 3A clockwise about the support shaft 16*g*1 as the rotation center.

In the present embodiment, the cam-shaped portion 16*g*2 of the retraction member 16*g* is formed so that a force pressing the solid lubricant 16*b* toward the lubricant supply roller 16*a* becomes substantially constant, and the amount of lubricant scraped off from the solid lubricant 16*b* by the lubricant supply roller 16*a* becomes constant even after the solid lubricant 16*b* is consumed and becomes smaller over time, that is, even after a height of the solid lubricant in the pressing direction becomes shorter.

As described above, in the present embodiment, the pressing device 160 is configured to apply the force pressing the solid lubricant 16*b* at both ends of the solid lubricant in the direction of the rotation axis, that is, both ends in the direction perpendicular to the sheet of FIG. 2.

First Embodiment

Figure 4:
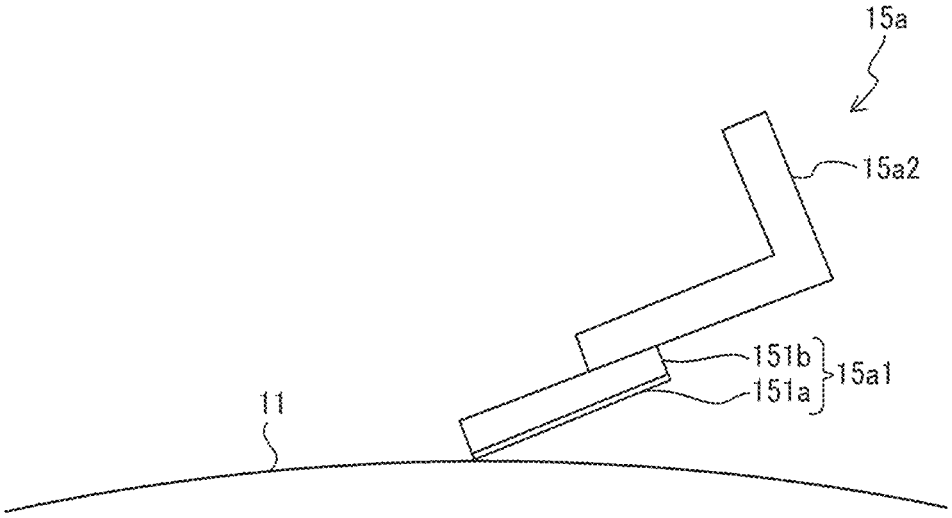
FIG. 4 is a schematic configuration diagram illustrating a cleaning blade of a photoconductor cleaning device in the image forming apparatus.

FIG. 4 is a schematic configuration diagram illustrating a cleaning blade 15*a*. The cleaning blade 15*a* includes a blade member 15*a*1 and an L-shaped metallic blade holder 15*a*2 to hold the blade member 15*al*. The blade member has a two-layer structure including a backup layer 151*b* and an edge layer 151*a* that includes an edge portion to contact the photoconductor 11.

The blade member 15*a*1 is formed by using centrifugal molding and sequentially superimposing layers. The centrifugal molding is a general and effective manufacturing method at present. The blade member 15*a*1 is attached to or adhered to the blade holder 15*a*2. The edge layer 151*a* and the backup layer 151*b* are formed by rubber such as urethane rubber having different hardness and made of different materials.

In addition to toner cleaning performance and wear resistance, the requirements for the cleaning blade include various kinds of characteristics such as prevention performance of toner adhesion like small fishes on the photoconductor 11, prevention performance for abnormal sound, and preventing the edge portion of the cleaning blade from chipping. Forming the blade member 15*a*1 in a laminated layer structure can easily satisfy the various cleaning characteristics and increase the freedom of material selection.

A toner removing capability of the cleaning blade 15*a* is required to be maintained over time and for any environment (low temperature, normal temperature, high temperature). The performance of the cleaning blade influences the life of the image forming unit 10. The demand for prolonging the life of the image forming unit 10 requires prolonging the life of the cleaning blade 15*a*, which brings about issues such as improvement of the wear resistance and keeping the toner removing capability for any environment.

Deterioration in the toner removing capability of the cleaning blade 15*a* causes the toner to pass through the cleaning blade, which causes the following two disadvantages: One is increase of toner contamination on the charging roller located downstream from the cleaning blade 15*a*, which is caused by the toner slipping between the cleaning blade and the photoconductor. The toner contamination on the charging roller causes defective charging such as uneven charging that results in defective images such as streaks and uneven image density.

The other is increase of toner contamination on the lubricant supply roller 16*a* caused by the toner slipping between the cleaning blade 15*a* and the photoconductor. The toner contamination on the lubricant supply roller 16*a* increase capability scraping off the solid lubricant 16*b* that results in excessive application of the lubricant to the photoconductor. The excessive application of the lubricant to the photoconductor causes lubricant contamination on the charging roller and is likely to cause uneven application of the lubricant to the photoconductor 11 because the excess lubricant is not uniformly applied. The uneven application of the lubricant causes a variation in charging property of the photoconductor 11 that causes a variation in surface potential, which causes uneven image density.

The wear of the edge portion of the cleaning blade is caused by the breakages of the molecular chains of the urethane rubber polymer in the edge. The breakages of the molecular chains of the urethane rubber polymer is affected by the magnitude of the accumulated stress concentrated on the edge portion. The small accumulated stress applied to the molecular chains of the urethane rubber polymer reduces the breakages of the molecular chains and the wear. The large accumulated stress applied to the molecular chains of the urethane rubber polymer increases the breakages of the molecular chains and the wear. Large rebound resilience of the urethane rubber easily causes a stick-slip movement in which the edge portion is pulled in the movement direction of the photoconductor and returns to the original position, but rubber strength (that is 100% modulus) affects ease of the stick-slip movement (that is number of times of the stick-slip movement) and the accumulated stress.

Materials having a low 100% modulus and high resilience are effective to prevent an increase in wear of the edge portion of the cleaning blade 15*a*. Since the materials having a low 100% modulus and high resilience easily deform when the frictional force acting between the edge portion and the photoconductor 11 pulls the edge portion to the downstream side in the movement direction of the photoconductor, large stress does not occur on the edge portion. This reduces the breakages of the molecular chains of the urethane rubber polymer and prevents wear.

However, too high rebound resilience easily causes the stick-slip movement of the edge portion. The stick-slip is a phenomenon in which the edge portion of the blade member 15*a*1 contacting the photoconductor 11 repeatedly changes between an original state and an elastically deformed state by the frictional force between the edge portion and the photoconductor 11. An occurrence of the stick-slip easily causes fluctuation of the contact pressure and causes a disadvantage that capability removing the toner and external additives deteriorates. Additionally, although the wear amount of the edge portion of the cleaning blade 15*a* is small, the stick-slip unevenly wears the edge portion, and a wear surface becomes rough, which easily causes uneven contact pressure and deterioration of the capability removing the toner and external additives. Such a state of the cleaning blade that is roughly worn is called fatigue wear.

On the other hand, using materials having a high 100% modulus and low resilience causes stick-slip motion of the edge portion to be less likely to occur and the fluctuation in the contact pressure to be less likely to occur. This improves the capability removing the toner and the external additives.

The edge portion having too high 100% modulus cannot easily deform when the frictional force acting between the edge portion and the photoconductor 11 pulls the edge portion to the downstream side in the movement direction of the photoconductor, and large stress occurs on the edge portion. This easily causes the breakages of the molecular chains of the urethane rubber polymer and the wear. In addition, local wear is likely to occur, in which a part away from the edge of the tip end surface of the blade, not the edge portion, is worn.

As described above, the relation between the 100% modulus and the rebound resilience of the material used in the edge portion is important in order to reduce the stick-slip movement and a wear rate, and keep the capability removing the toner and external additives over a long period.

In general, urethane rubber materials have a correlation between the 100% modulus and the rebound resilience. When the 100% modulus is low, the rebound resilience is high. When the 100% modulus is high, the rebound resilience is low. Therefore, setting the 100% modulus and the rebound resilience independently is not suitable for actual use because setting the 100% modulus and the rebound resilience independently includes a case impossible to make. Therefore, the inventors conducted the following evaluation tests to derive the correlation between the rebound resilience and the 100% modulus that can balance the reduction of the wear amount and the improvement of the capability removing the toner and external additives.

First Evaluation Test

A first evaluation test performed by the inventors is described below.

The cleaning blades 15*a* of examples 1 to 19 and comparative examples 1 to 13 were made and evaluated. The cleaning blades had two-layer structures each including a backup layer 151*b* and an edge layer 151*a* as illustrated in FIG. 4. The blade member 15*a*1 of each cleaning blade was adhered and fixed to an L-shaped metal blade holder 15*a*2. The edge layer 151*a* had a layer thickness of 0.5 mm, and the backup layer 115*b* had a layer thickness of 1.5 mm. The free length of the blade member was adjusted so that the linear pressure was about 20 g/cm.

The present inventors chose the urethane rubber materials E1 to E34 for the edge layer 151*a* of each cleaning blade based on 100% modulus values M35 at temperature 35° C. and rebound resilience values R35 at temperature 35° C. The following is the reason why the present inventors chose the rubber materials of the edge layer of the cleaning blades based on the 100% modulus values M35 at temperature 35° C. and the rebound resilience values R35 at temperature 35° C.: Typically, physical property values such as 100% modulus values and rebound resilience values were defined at room temperature (23° C. to 25° C.) in general offices.

However, a temperature of the atmosphere around the cleaning blade in the electrophotographic image forming apparatus using the cleaning blade rises to about 30° C. to 40° C. This is because the electrophotographic image forming apparatus has a heat source such as a fixing device and rotates the photoconductor in high speed, for example, 300 mm/s in high speed apparatuses.

Therefore, definition of the physical property values at the room temperature (23° C. to 25° C.) in most offices is not suitable for the actual use and sometimes causes significant differences between prediction and reality in cleaning performance over time.

For example, one of the reasons is as follows. Reducing the wear amount of the cleaning blade 15*a* is important to extend the life of the cleaning blade 15*a*. The frictional force generated when the edge portion of the cleaning blade slides on the photoconductor 11 causes stick-slip movement in which the edge portion of the blade member 15*a*1 repeatedly changes between an original state and an elastically deformed state. The larger the rebound resilience values of the rubber materials used for the cleaning blade tips are, the larger the stick-slip movement becomes. Generally, the higher the temperature of the urethane rubber is, the larger the rebound resilience values are. Therefore, even if the rebound resilience value at 23° C. is 30%, when the rebound resilience value at 35° C. is 50%, a real amount of the stick-slip movement in the image forming apparatus becomes larger than an amount considered based on the rebound resilience value 30% and the wear amount of the edge portion increases more than expected.

As described above, definition of the physical property values at the room temperature (23° C. to 25° C.) in most offices is not suitable for the actual use and may cause significant difference between prediction and reality in cleaning performance over time. Therefore, in the evaluation tests of the present disclosure, conditions are defined based on physical property values at 35° C.

Material B1 is commonly used for the backup layers of the cleaning blades in Examples 1 to 19 and Comparative Examples 1 to 13, and the physical properties of the material of the backup layers are illustrated in Table 1.

TABLE 1

| Physical Properties of Backup layer | | | | | | |
|---|---|---|---|---|---|---|
| 100% modulus value at | Rebound resilience value [%] | | | | | Tan δ peak temperature |
| 35° C. [MPa] | 0° C. | 10° C. | 23° C. | 35° C. | 50° C. | [° C.] |
| 4.0 | 8.0 | 16.0 | 44.5 | 65.0 | 71.5 | −3.6 |

The rebound resilience values can be measured by a resilience measurement instrument No. 221 manufactured by Toyo Seiki Seisaku-sho, Ltd. according to JIS-K 6255 at each of temperatures in Table 1. The 100% modulus value was measured according to JIS-K6251 by using a tensile tester AG-X manufactured by Shimadzu Corporation.

Tan δ peak temperature of the urethane rubber was measured by using DMS 6100 manufactured by SII Nano Technology. Sample size was 2×2×40 mm, and samples were continuously measured with a temperature increase of 3° C./min from −50° C. to +100° C. in a tension mode of 1 Hz.

<A Printing Operation to Wear the Cleaning Blade>

In the first evaluation test, to evaluate the cleaning blade, the cleaning blade was worn by the printing operation under the following conditions.

Evaluation environment: 23° C. and 50% RH

The image forming apparatus used in the printing operation: MPC5100S manufactured by Ricoh co, Ltd.

A running chart used in the printing operation: image area rate of 5% and A4 size (the printing operation was performed so that the longer side of A4 sheet was parallel to the photoconductor axis)

Photoconductor running distance in the printing operation: 200 km

After the printing operation described above, the inventors performed following Evaluations 1 to 4 to evaluate the cleaning blade:

<Evaluation 1: Measurement of the Wear Rate>

In measurement of the ware rate, a ware area S $\mu m^2$ was determined by observing a three-dimensional image of the tip of the cleaning blade after the printing operation with the laser microscope VK-9500 manufactured by KEYENCE. The wear area S is a cross-sectional area of a portion lost from the initial state by the printing operation, as illustrated in the hatched portion in FIG. 5. The ware rate was determined by dividing the wear area S determined above by the photoconductor traveling distance (200 km).

<Evaluation 2: Evaluation of a Ware Surface>

Figure 6:
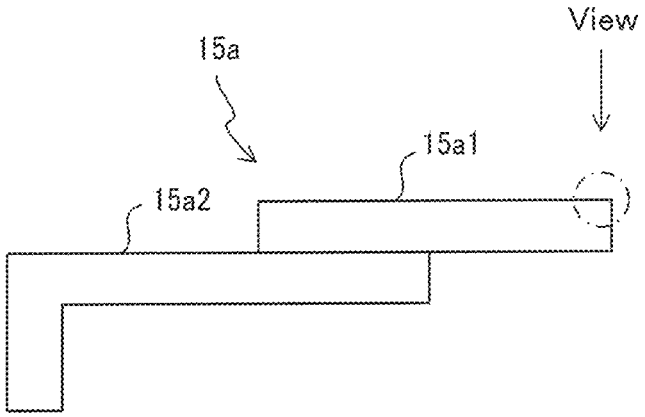
FIG. 6 is an explanatory diagram illustrating a direction to observe wear.
Figure 7A:
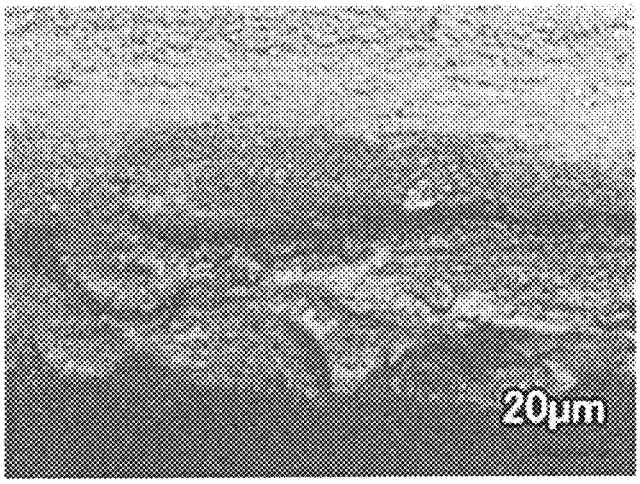
FIG. 7A is a view illustrating an example of fatigue wear.
Figure 7B:
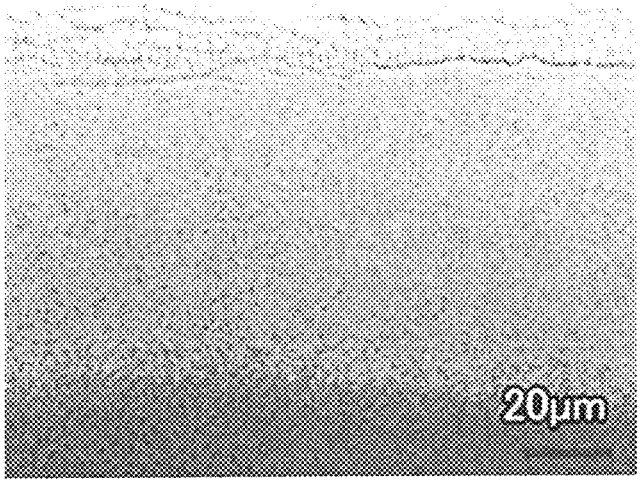
FIG. 7B is a view illustrating an example of mirror-surface wear.
Figure 7C:
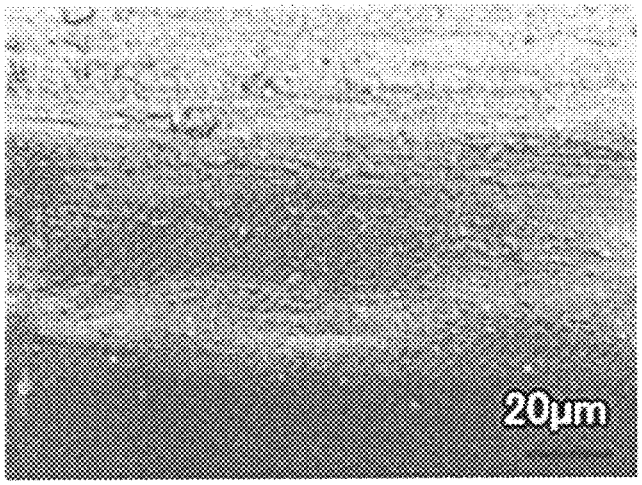
FIG. 7C is a view illustrating an example of intermediate wear.

To evaluate the ware surface of the cleaning blade after the printing operation, the laser microscope VK-100 manufactured by was used, and the wear surface was observed in a direction illustrated by a straight arrow in FIG. 6. The lens magnification was 100 times. Fatigue wear was defined as a wear surface on which large unevenness was observed, as illustrated in FIG. 7A. Mirror-surface wear was defined as a smooth ware surface on which unevenness was not observed, as illustrated in FIG. 7B. Intermediate wear was defined as an intermediate wear surface between the mirror-surface wear and the fatigue wear, as illustrated in FIG. 7C. In addition, local wear was defined as a wear surface locally formed on the tip surface several μm away from the edge portion.

<Evaluation 3: Cleaning Performance Under Low Temperature Environment>

Cleaning performance under low temperature environment was evaluated after printing under the following conditions.

Evaluation environment: 10° C. and 15% RH

The image forming apparatus used in the evaluation 3: MPC5100S manufactured by Ricoh Co., Ltd.

The cleaning blade used in the evaluation 3: the cleaning blade used in the printing operation described above. In the printing operation, the photoconductor rotated until the photoconductor travel distance reaches 200 km.

A running chart used in the evaluation 3: a running chart including vertical solid band in the A4 size (Printing was performed so that the longer side of A4 sheet was parallel to the photoconductor axis)

A number of printed sheets in the evaluation 3: 1000 sheets

Figure 8:
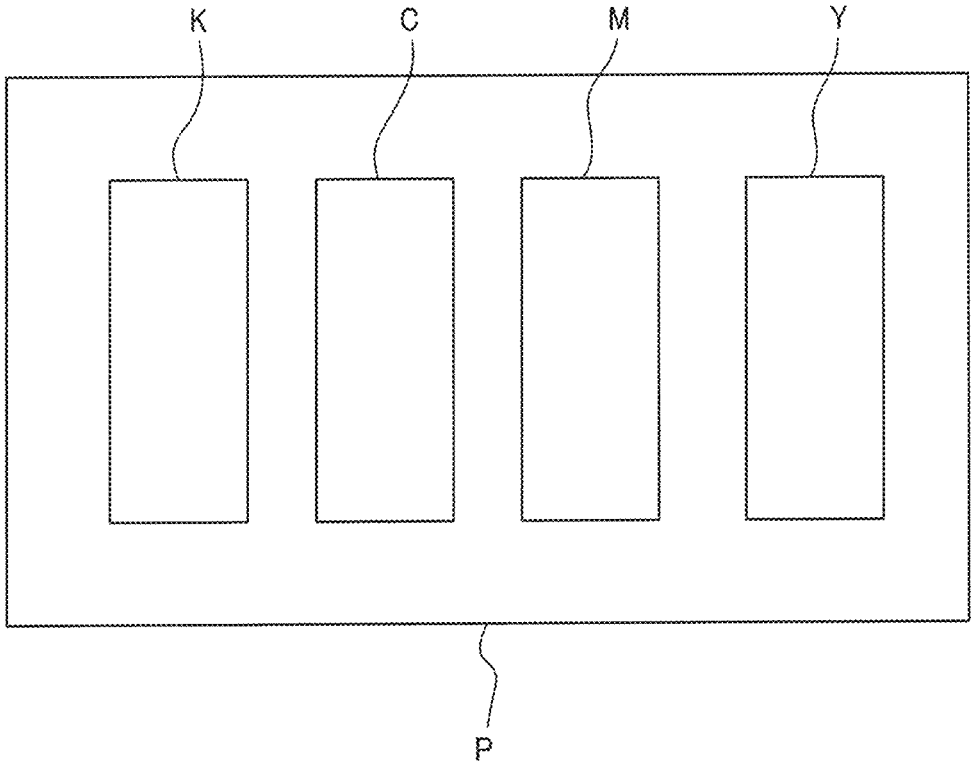
FIG. 8 is a schematic diagram illustrating a running chart used in evaluations under a low temperature environment.

FIG. 8 is a schematic diagram illustrating a running chart used in the evaluation 3 under low temperature.

As illustrated in FIG. 8, in the running chart, black, cyan, magenta and yellow vertical solid bands are arranged at predetermined intervals.

Cleaning performance levels are defined as follows based on images output in the printing under the low temperature environment described above.

Good: No abnormal image due to cleaning failure is found in one thousand sheets output in the evaluation 3.

Fair: The abnormal image due to the cleaning failure is found in ten or less sheets of the one thousand sheets output in the evaluation 3.

Poor: The abnormal image due to the cleaning failure is found in eleven to thirty sheets of the one thousand sheets output in the evaluation 3.

Very poor: The abnormal image due to the cleaning failure is found in thirty one or more sheets of the one thousand sheets output in the evaluation 3.

Figure 9A:
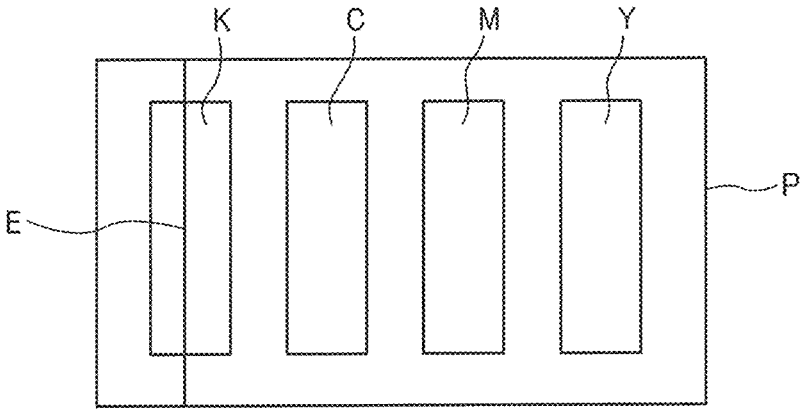
FIGS. 9A to 9C are schematic diagrams illustrating some examples of defective images due to cleaning failures.
Figure 9B:
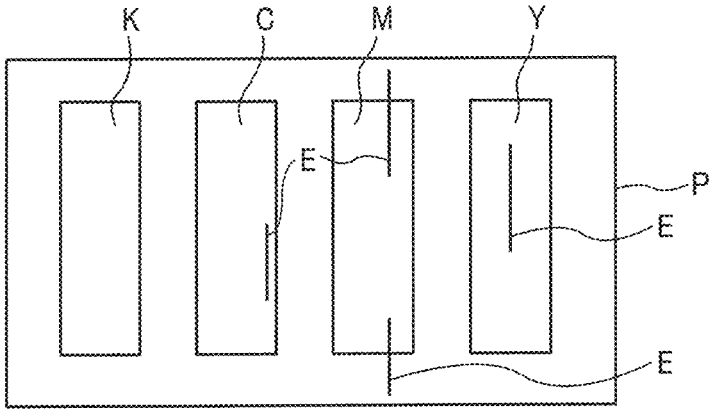
Figure 9C:
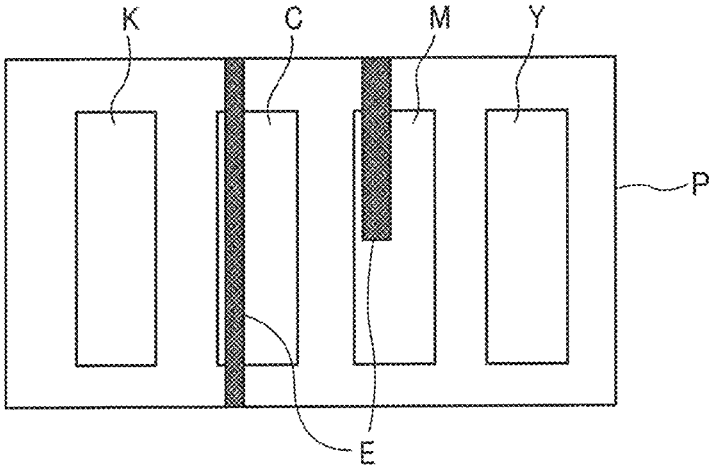

FIGS. 9A to 9C are schematic diagrams illustrating some examples of defective images due to the cleaning failures. FIG. 9A is an example in which the cleaning failure occurs in the black vertical solid band K, and a streak-shaped abnormal image E are continuously generated on the image. FIG. 9B is an example in which the cleaning failure occurs in the cyan, magenta, and yellow vertical solid band C, M, and Y, and a short streak-shaped defective images E occur intermittently. FIG. 9C is an example in which a large amount of the cleaning failure occurs in the cyan and magenta vertical solid band C and M in the width direction, which results in thick streak shaped defective images E. As described above, the cleaning failure often occurs corresponding to the vertical solid bands in the running chart because much toner is input to the cleaning blade corresponding to the vertical solid bands.

<Evaluation 4: Charging Roller Contamination Evaluation>

The charging roller contamination was indirectly evaluated by an amount of toner slipping between the cleaning blade and the photoconductor instead of directly measuring the contamination of the charging roller surface. Increase in the amount of toner slipping between the cleaning blade and the photoconductor causes increase toner adhesion on the lubricant supply roller 16*a* illustrated in FIG. 2, which causes increase of a consumption rate of the lubricant 16*b* and increase of the charging roller contamination because the charging roller in the charger 12 is disposed downstream from the lubricant supply roller 16*a*. Therefore, measuring the amount of toner slipping between the cleaning blade and the photoconductor allows indirect evaluation of the charging roller contamination. The amount of toner slipping between the cleaning blade and the photoconductor was measured based on an amount of toner adhering to the lubricant supply roller 16*a*.

The amount of toner adhering to the lubricant supply roller 16*a* was evaluated after printing under the following conditions. Hereinafter, this printing is referred to as a slipping toner running test.

The image forming apparatus used in the evaluation 4: MPC5100S manufactured by Ricoh Co., Ltd.

The cleaning blade used in the evaluation 4: the cleaning blade used in the printing operation described above. In the printing operation, the photoconductor rotated until the photoconductor travel distance reaches 200 km.

A running chart used in the evaluation 4: the running chart including vertical solid band in the A4 size (see FIG. 8, Printing was performed so that the longer side of A4 sheet was parallel to the photoconductor axis)

A number of printed sheets in the evaluation 4: 1000 sheets

Figure 10A:
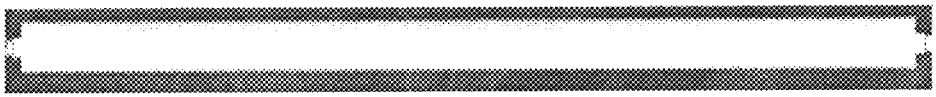
FIG. 10A is a view illustrating an example of a lubricant supply roller before a slipping toner running test, that is, printing to evaluate an amount of toner slipping between the cleaning blade and a photoconductor.
Figure 10B:
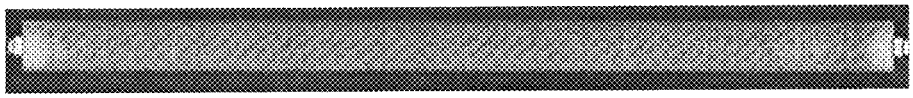
FIG. 10B is a view illustrating an example of the lubricant supply roller after the slipping toner running test.

The amount of toner slipping between the cleaning blade and the photoconductor was measured based on the amount of toner adhering to the lubricant supply roller 16*a*. A scanner read a surface of the new lubricant supply roller 16*a* as illustrated in FIG. 10A before the slipping toner running test and measured a brightness value L0. After the slipping toner running test, the scanner read the surface of the lubricant supply roller 16*a* as illustrated in FIG. 10B and measured a brightness value L1. Next, the difference of the brightness values, $\Delta L(=L0-L1)$, before and after the slipping toner running test described above was obtained. That is, a decrease in the brightness value of the lubricant supply roller 16*a* due to the toner slipping between the cleaning blade and the photoconductor was a substitute characteristic of the amount of toner slipping between the cleaning blade and the photoconductor.

The charging roller contamination, that is, the amount of toner slipping between the cleaning blade and the photoconductor was ranked as follows based on $\Delta L$.

Good: $\Delta L \leq 25$

Fair: $25 \leq \Delta L \leq 50$

Poor: $50 < \Delta L \leq 75$

Very poor: $75 < \Delta L$

Figure 11:
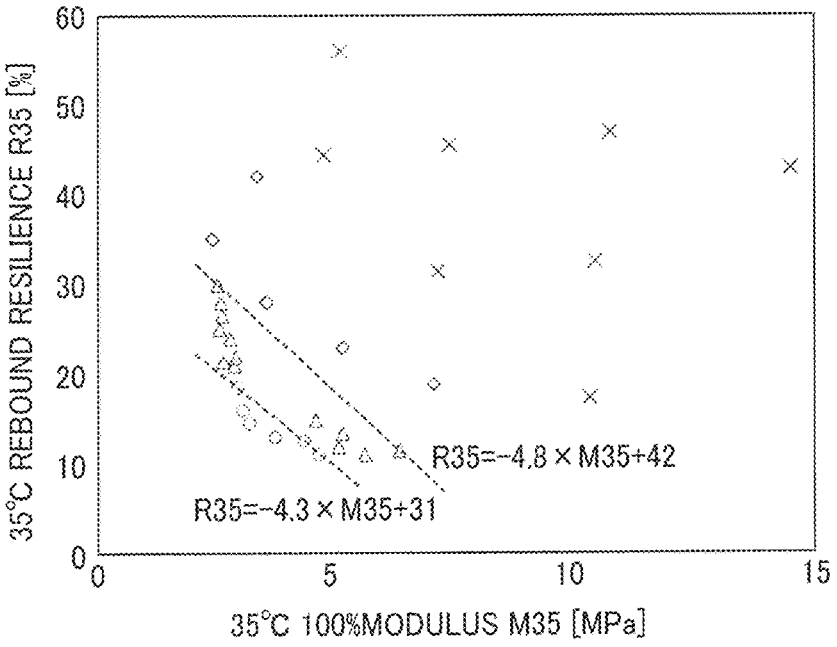
FIG. 11 is a graph illustrating a relation between rebound resilience at 35° C. and 100% modulus value at 35° C. in Examples 1 to 19 and Comparative Examples 1 to 13 in a first embodiment.

Table 2 lists results of evaluations described above and the physical properties of urethane rubber E1 to E34 that are used in the edge layers of the cleaning blades in Examples 1 to 19 and Comparative Examples 1 to 13. FIG. 11 is a graph illustrating a relation between rebound resilience at 35° C. and 100% modulus value at 35° C. in Examples 1 to 19 and Comparative Examples 1 to 13. In FIG. 11, circles correspond to "good" of comprehensive evaluation results, triangles correspond to "fair" of the comprehensive evaluation results, diamonds correspond to "poor" of the comprehensive evaluation results, and x-marks correspond to "very poor" of the comprehensive evaluation results.

TABLE 2

| | Edge layer | Backup layer | Physical Properties of Backup layer | | | |
|---|---|---|---|---|---|---|
| | | | 100% modulus at 35° C. [MPa] | Rebound resilience at 10° C. [%] | Rebound resilience at 35° C. [%] | Tan δ peak temperature [° C.] |
| Example 1 | E1 | B1 | 2.47 | 9.0 | 30.0 | −2.0 |
| Example 2 | E2 | B1 | 2.50 | 10.5 | 25.0 | 13.3 |
| Example 3 | E3 | B1 | 2.52 | 8.5 | 28.0 | −0.6 |
| Example 4 | E4 | B1 | 2.57 | 9.5 | 26.5 | 9.1 |
| Example 5 | E5 | B1 | 2.58 | 12.0 | 21.5 | 9.3 |
| Example 6 | E6 | B1 | 2.74 | 11.0 | 24.0 | 1.0 |
| Example 7 | E7 | B1 | 2.80 | 12.5 | 21.0 | 12.2 |
| Example 8 | E8 | B1 | 2.84 | 13.5 | 22.0 | 3.3 |
| Example 9 | E9 | B1 | 2.90 | 14.5 | 18.5 | 12.5 |
| Example 10 | E10 | B1 | 3.00 | 17.5 | 16.0 | 14.5 |
| Example 11 | E11 | B1 | 3.15 | 19.0 | 14.5 | 16.6 |
| Example 12 | E12 | B1 | 3.68 | 22.5 | 13.0 | 8.9 |
| Example 13 | E13 | B1 | 4.30 | 21.5 | 12.5 | 14.0 |
| Example 14 | E14 | B1 | 4.60 | 22.0 | 11.0 | 18.8 |
| Example 15 | E15 | B1 | 4.52 | 22.5 | 15.0 | 20.2 |
| Example 16 | E16 | B1 | 5.00 | 27.5 | 12.0 | 12.6 |
| Example 17 | E17 | B1 | 5.10 | 24.5 | 13.5 | 10.7 |
| Example 18 | E18 | B1 | 5.57 | 26.0 | 11.0 | 15.4 |
| Example 19 | E19 | B1 | 6.30 | 25.5 | 11.5 | 16.0 |
| Comparative Example 1 | E22 | B1 | 2.35 | 7.5 | 35.0 | 8.8 |
| Comparative Example 2 | E23 | B1 | 3.30 | 9.0 | 42.0 | 3.1 |
| Comparative Example 3 | E24 | B1 | 3.50 | 14.0 | 28.0 | 15.7 |
| Comparative Example 4 | E25 | B1 | 4.70 | 28.5 | 44.5 | −5.0 |
| Comparative Example 5 | E26 | B1 | 5.05 | 13.5 | 56.0 | 2.7 |
| Comparative Example 6 | E27 | B1 | 5.10 | 11.0 | 23.0 | 0.9 |
| Comparative Example 7 | E28 | B1 | 7.00 | 21.5 | 19.0 | 10.0 |
| Comparative Example 8 | E29 | B1 | 7.07 | 20.0 | 31.5 | −2.0 |
| Comparative Example 9 | E30 | B1 | 7.35 | 32.5 | 45.5 | −2.8 |
| Comparative Example 10 | E31 | B1 | 10.30 | 22.5 | 17.5 | 13.5 |
| Comparative Example 11 | E32 | B1 | 10.40 | 20.5 | 32.5 | 21.1 |
| Comparative Example 12 | E33 | B1 | 10.71 | 37.0 | 47.0 | −4.7 |
| Comparative Example 13 | E34 | B1 | 14.50 | 32.5 | 43.0 | −4.0 |

| | Results of evaluations | | | | |
|---|---|---|---|---|---|
| | Wear Rate [$\mu m^2$/km] | Wear surface | Cleaning performance | Charging roller contamination | Comprehensive evaluation |
| Example 1 | 2.41 | Intermediate wear | Good | Fair | Fair |
| Example 2 | 2.27 | Intermediate wear | Good | Fair | Fair |
| Example 3 | 2.30 | Intermediate wear | Good | Fair | Fair |
| Example 4 | 2.43 | Intermediate wear | Good | Fair | Fair |
| Example 5 | 2.03 | Intermediate wear | Good | Fair | Fair |
| Example 6 | 2.32 | Intermediate wear | Good | Fair | Fair |
| Example 7 | 2.10 | Intermediate wear | Good | Fair | Fair |
| Example 8 | 2.21 | Intermediate wear | Good | Fair | Fair |
| Example 9 | 2.01 | Mirror-surface | Good | Good | Good |
| Example 10 | 2.26 | Mirror-surface | Good | Good | Good |

TABLE 2-continued

| | | | | | |
|---|---|---|---|---|---|
| Example 11 | 2.49 | Mirror-surface | Good | Good | Good |
| Example 12 | 2.74 | Mirror-surface | Good | Good | Good |
| Example 13 | 3.05 | Mirror-surface | Good | Good | Good |
| Example 14 | 3.01 | Mirror-surface | Good | Good | Good |
| Example 15 | 3.25 | Mirror-surface | Fair | Fair | Fair |
| Example 16 | 3.40 | Mirror-surface | Fair | Fair | Fair |
| Example 17 | 3.51 | Mirror-surface | Fair | Fair | Fair |
| Example 18 | 3.61 | Mirror-surface | Fair | Fair | Fair |
| Example 19 | 3.90 | Mirror-surface | Fair | Fair | Fair |
| Comparative Example 1 | 3.51 | Fatigue wear | Fair | Poor | Poor |
| Comparative Example 2 | 4.40 | Fatigue wear | Poor | Poor | Poor |
| Comparative Example 3 | 4.20 | Intermediate wear | Poor | Fair | Poor |
| Comparative Example 4 | 5.53 | Fatigue wear | Very poor | Poor | Very poor |
| Comparative Example 5 | 5.76 | Fatigue wear | Very poor | Poor | Very poor |
| Comparative Example 6 | 4.05 | Intermediate wear | Poor | Poor | Poor |
| Comparative Example 7 | 4.51 | Mirror-surface | Poor | Poor | Poor |
| Comparative Example 8 | 6.03 | Fatigue wear | Very poor | Very poor | Very poor |
| Comparative Example 9 | 6.54 | Fatigue wear | Very poor | Very poor | Very poor |
| Comparative Example 10 | 5.75 | Local wear | Very poor | Very poor | Very poor |
| Comparative Example 11 | 6.53 | Local wear | Very poor | Very poor | Very poor |
| Comparative Example 12 | 7.01 | Local wear | Very poor | Very poor | Very poor |
| Comparative Example 13 | 7.75 | Local wear | Very poor | Very poor | Very poor |

The comprehensive evaluation illustrated in Table 2 was rated in four grades based on evaluation items, the wear surface, the cleaning performance under low temperature environment, the charging roller contamination. The comprehensive evaluation was determined based on the worst evaluation result among the three evaluation items. For example, in Example 1, although the cleaning performance under the low temperature environment was good, because the wear surface and the charging roller contamination were fair, the comprehensive evaluation was fair. In Example 9, because the wear surface, the cleaning performance under the low temperature environment, and the charging roller contamination were good, the comprehensive evaluation was good. Additionally, In Comparative Example 1, although the cleaning performance under the low temperature environment was fair, because the wear surface and the charging roller contamination were poor, the comprehensive evaluation was poor.

In all of Examples 1 to 19, the comprehensive evaluation was fair or good, that is, good results were obtained. On the other hand, in Comparative Examples 1 to 13, because any one of the wear surface, the cleaning performance under the low temperature environment, and the charging roller contamination was poor or very poor, the comprehensive evaluation was poor or very poor.

In addition, as illustrated in FIG. 11, the lower the 35° C. 100% modulus value and the 35° C. rebound resilience were, the better the comprehensive evaluation was. That is, the lower strength and the lower rebound resilience resulted in the better comprehensive evaluation. In contrast, the higher strength and the higher rebound resilience resulted in the worse comprehensive evaluation.

Further, FIG. 11 illustrates a boundary line that can be drawn between the comprehensive evaluation "fair" that is triangles in FIG. 11 and the comprehensive evaluation "poor" that is diamonds in FIG. 11. This boundary line can be expressed as $R35=-4.8M35+42$, where R35 is the rebound resilience values R35 at temperature 35° C., and M35 is the 100% modulus values M35 at temperature 35° C. That is, FIG. 11 illustrates that satisfying the relation $R35=-4.8M35+42$ that is the relation between rebound resilience at 35° C. and 100% modulus value at 35° C. can reduce the stick-slip movement and the fatigue wear with the large uneven wear surface, prevent the wear, and make the cleaning blade having good wear resistance. As a result, even after the photoconductor travels at 200 km in printing, the cleaning blade that satisfy the relation $R35=-4.8M35+42$ can reduce the toner slipping between the cleaning blade and the photoconductor and keep good cleaning performance.

FIG. 11 also illustrates a boundary line that can be drawn between the comprehensive evaluation "fair" that is triangles in FIG. 11 and the comprehensive evaluation "good" that is circles in FIG. 11. This boundary line can be expressed as $R35=-4.3M35+31$, where R35 is the rebound resilience values R35 at temperature 35° C., and M35 is the 100% modulus values M35 at temperature 35° C. That is, satisfying the relation R35=−4.3M35+31 that is the relation between rebound resilience at 35° C. and 100% modulus value at 35° C. can make the cleaning blade having better wear resistance.

The 100% modulus value at 35° C. of the edge layers of Examples 1 to 19 was 6.3 MPa or less. Setting the 100% modulus value at 35° C. of the edge layer at 6.3 MPa or less appropriately deforms the edge portion of the cleaning blade and can prevent the wear of the cleaning blade from being accelerated by projections on the photoconductor surface and inclusions such as toner additive (silica), which can reduce the wear rate to 4.00 $\mu m^2$/km or less. Setting the 100% modulus value at 35° C. of the edge layer at 6.3 MPa or less can reduce the toner slipping between the cleaning blade and the photoconductor after the photoconductor travels at 200 km in printing to keep the good cleaning performance. However, the 100% modulus value of urethane rubber cannot be indefinitely reduced and is generally 2 MPa or more.

The above-described first evaluation test illustrates that, to make the edge layer having excellent wear resistance, the strength and the rebound resilience is preferably set as low as possible, that is, the 100% modulus at 35° C. and the rebound resilience at 35° C. is preferably set as low as possible. However, the urethane rubber having the low rebound resilience tends to lose rubber property. The tan δ peak temperature indicates the rubber property as the index. Lower tan δ peak temperature means that the rubber keeps the rubber property even under low temperature, and higher tan δ peak temperature means that the rubber has the low rubber property under low temperature. The cleaning blade having the low rubber property under low temperature does not generate pressure to remove foreign substances such as the toner and the external additives from the photoconductor surface, and the toner slips between the cleaning blade and the photoconductor, which results in poor cleaning performance under the low temperature.

However, in the examples in Table 2, good cleaning performance under the low temperature environment is found despite high tan δ peak temperature of the edge layer. In particular, the cleaning blade in Example 14 obtains the good cleaning performance under the low temperature despite high tan δ peak temperature that is 20.2° C., higher than 10° C. of the low temperature environment by 10° C. or more. The tan δ peak temperature in the backup layer B1 of Example 14 is −3.6° C. lower than the one in the edge layer. Furthermore, the tan δ peak temperature in the backup layer B1 is equal to or lower than 0° C. and a value sufficiently lower than 10° C. of the low temperature environment. This enables the backup layer to keep good rubber property even under 10° C. of the low temperature environment and prevents the rubber property of the cleaning blade as a whole from deteriorating. Therefore, even under the low temperature environment, the cleaning blade can maintain the pressure to remove foreign substances from the photoconductor surface and the cleaning performance.

Next, the present inventors conducted a second evaluation test on how the rebound resilience of the backup layer affects the cleaning performance. Hereinafter, the second evaluation test is described.

Second Evaluation Test

Figure 12:
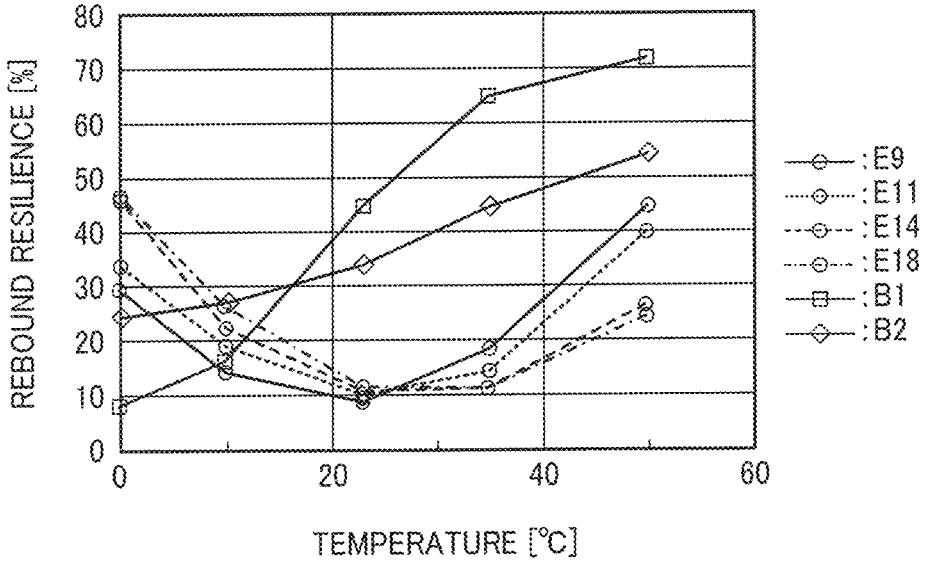
FIG. 12 is a graph illustrating relations between temperature and rebound resilience in various materials of an edge layer or a backup layer.

The present inventors selected the Example 9, the Example 11, the Example 14, and the Example 18 in Table 2 described above as representative examples of low rebound resilience materials and made sets of the representative examples and different backup layers B1 and B2 to make two-layer cleaning blades and compare their cleaning performance under the low temperature environment 10° C. In addition, in order to confirm the effect of the backup layer, the present inventors made two single-layer blades made of the materials of the Example 9 and the Example 14. Table 3 lists physical property values of the edge layers and the backup layers of the cleaning blades used in the second evaluation test. FIG. 12 is a graph illustrating relations between temperature and rebound resilience in the materials of the edge layers E9, E11, E14, and E18 and the materials of the backup layers B1 and B2. The present inventors selected the materials of the edge layers from examples in which results of the wear surface were the mirror-surface wear in Table 2 in order to exclude the influence of the wear surface. In addition, in order to confirm the effect of the backup layer, the present inventors selected the materials of the edge layers having tan δ peak temperature higher than 10° C. from Table 2.

TABLE 3

| | Physical Properties of Edge layer | | | | | | | |
|---|---|---|---|---|---|---|---|---|
| | Edge layer | 100% modulus at 35° C. [MPa] | Rebound resilience [%] 0° C. | 10° C. | 23° C. | 35° C. | 50° C. | Tan δ peak temperature [° C.] |
| Example 9 | E9 | 2.90 | 29.5 | 14.5 | 9.0 | 18.5 | 44.5 | 12.5 |
| Example 11 | E11 | 3.15 | 33.5 | 19.0 | 9.5 | 14.5 | 39.5 | 16.6 |
| Example 15 | E14 | 4.60 | 46.0 | 22.0 | 10.0 | 11.0 | 26.0 | 18.8 |
| Example 18 | E18 | 5.57 | 46.5 | 26.0 | 11.5 | 11.0 | 24.5 | 15.4 |
| Example 20 | E9 | 2.90 | 29.5 | 14.5 | 9.0 | 18.5 | 44.5 | 12.5 |
| Example 21 | E11 | 3.15 | 33.5 | 19.0 | 9.5 | 14.5 | 39.5 | 16.6 |
| Example 22 | E14 | 4.60 | 46.0 | 22.0 | 10.0 | 11.0 | 26.0 | 18.8 |
| Example 23 | E18 | 5.57 | 46.5 | 26.0 | 11.5 | 11.0 | 24.5 | 15.4 |
| Example 24 | E9 | 2.9 | 29.5 | 14.5 | 9.0 | 18.5 | 44.5 | 12.5 |
| Example 25 | E14 | 4.6 | 46.0 | 22.0 | 10.0 | 11.0 | 26.0 | 18.8 |

TABLE 3-continued

| | Backup layer | Physical Properties of Backup layer: 100% modulus at 35° C. [MPa] | Rebound resilience [%] 0° C. | 10° C. | 23° C. | 35° C. | 50° C. | Tan δ peak temperature [° C.] |
|---|---|---|---|---|---|---|---|---|
| Example 9 | B1 | 4.0 | 8.0 | 16.0 | 44.5 | 65.0 | 71.5 | −3.6 |
| Example 11 | B1 | 4.0 | 8.0 | 16.0 | 44.5 | 65.0 | 71.5 | −3.6 |
| Example 15 | B1 | 4.0 | 8.0 | 16.0 | 44.5 | 65.0 | 71.5 | −3.6 |
| Example 18 | B1 | 4.0 | 8.0 | 16.0 | 44.5 | 65.0 | 71.5 | −3.6 |
| Example 20 | B2 | 4.1 | 24.5 | 27.0 | 34.0 | 44.5 | 54.5 | −3.4 |
| Example 21 | B2 | 4.1 | 24.5 | 27.0 | 34.0 | 44.5 | 54.5 | −3.4 |
| Example 22 | B2 | 4.1 | 24.5 | 27.0 | 34.0 | 44.5 | 54.5 | −3.4 |
| Example 23 | B2 | 4.1 | 24.5 | 27.0 | 34.0 | 44.5 | 54.5 | −3.4 |
| Example 24 | None | | | | | | | |
| Example 25 | None | | | | | | | |

As illustrated in FIG. 12, the rebound resilience value of the backup layer B2 at 10° C. was higher than each of the rebound resilience values of the edge layers at 10° C. In addition, in the second evaluation test, the present inventors selected the materials for the backup layers B1 and B2 to have substantially the same tan δ peak temperature, that is, −3.6° C. of the backup layer B1 and −3.4° C. of the backup layer B2. Above-described selection allows for accurate evaluation of the influence of the rebound resilience of the backup layer.

A printing operation to wear the cleaning blade was performed under the following conditions for each of cleaning blades listed as Examples in Table 3. In the printing operation, the wear area of the cleaning blade was measured at predetermined travel distances of the photoconductor, and, at the same timing, accelerated test of the cleaning performance under the low temperature environment was performed. As a result, relation between the wear area of the cleaning blade and the cleaning performance under the low temperature environment was obtained.

<A Printing Operation to Wear the Cleaning Blade>

In the first evaluation test, to evaluate the cleaning blade, the cleaning blade was worn by the printing operation under the following conditions.

Evaluation environment: 23° C. and 50% RH

The image forming apparatus used in the printing operation: MPC5100S manufactured by Ricoh Co., Ltd.

A running chart used in the printing operation: image area rate of 5% and A4 size (the printing operation was performed so that the longer side of A4 sheet was parallel to the photoconductor axis)

At predetermined photoconductor running distances, which correspond to First, Second, Third, and Fourth in Table 4, the wear areas of each of the cleaning blades were measured, and the cleaning performance under the low temperature in each running distance in each cleaning blade was evaluated by the accelerated test of the cleaning performance under the low temperature environment. The accelerated test is described below:

<Evaluation 4: Accelerated Test of the Cleaning Performance Under the Low Temperature Environment>

Evaluation environment: 10° C. and 15% RH

The image forming apparatus used in the evaluation 4: MPC5100S manufactured by Ricoh Co., Ltd.

In conditions of the charger in the image forming apparatus, a peak-to-peak voltage (Vpp) kV applied to the charging roller is set to 1.2 times the default condition.

The cleaning blade was evaluated after the wear area was measured when the travel distance of the photoconductor reaches each of the predetermined travel distances described above.

A running chart used in the evaluation 4 was a running chart including vertical solid band in the A4 size, and the running chart was printed 500 sheets so that the longer side of A4 sheet was parallel to the photoconductor axis.

In the accelerated test of the cleaning performance under the low temperature environment, the cleaning performance was ranked as follows.

Rank 5 is a case when no abnormal image due to cleaning failure is in 500 sheets output in the evaluation 4.

Rank 4 is a case when abnormal image due to cleaning failure occurs after 401 sheets were output in the evaluation 4.

Rank 3 is a case when abnormal image due to cleaning failure occurs after 101 sheets were output and before 401 sheets were output in the evaluation 4.

Rank 2 is a case when abnormal image due to cleaning failure occurs after 11 sheets were output and before 101 sheets were output in the evaluation 4.

Rank 1 is a case when abnormal image due to cleaning failure occurs before 11 sheets were output in the evaluation 4.

Figure 13:
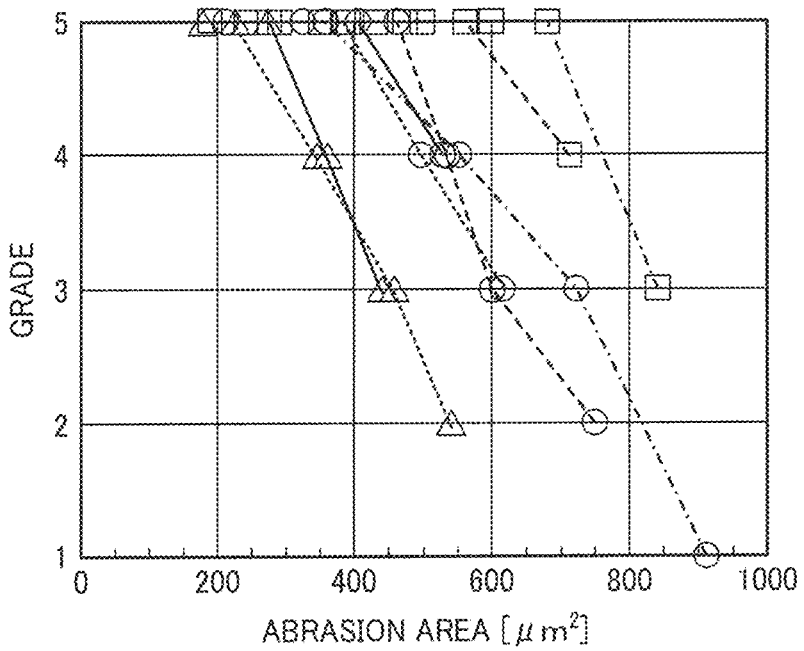
FIG. 13 is a graph illustrating relations between wear areas and grades of defective images due to the cleaning failures in various examples of a second evaluation test performed under the low temperature environment.

Table 4 below lists the results of the accelerated test of the cleaning performance under the low temperature environment. FIG. 13 is a graph illustrating relations in the examples between the wear areas and the results of the accelerated test of the cleaning performance under the low temperature environment that are expressed by Ranks described above.

TABLE 4

| | Example 9 | | Example 11 | | Example 15 | | Example 18 | |
|---|---|---|---|---|---|---|---|---|
| | Wear area [μm²] | Rank | Wear area [μm²] | Rank | Wear area [μm²] | Rank | Wear area [μm²] | Rank |
| First | 210 | 5 | 247 | 5 | 298 | 5 | 358 | 5 |
| Second | 325 | 5 | 383 | 5 | 462 | 5 | 552 | 4 |
| Third | 402 | 5 | 498 | 4 | 602 | 3 | 722 | 3 |
| Fourth | 530 | 4 | 615 | 3 | 750 | 2 | 913 | 1 |

TABLE 4-continued

| | Example 20 | | Example 21 | | Example 22 | | Example 23 | |
|---|---|---|---|---|---|---|---|---|
| | Wear area [μm²] | Rank | Wear area [μm²] | Rank | Wear area [μm²] | Rank | Wear area [μm²] | Rank |
| First | 190 | 5 | 240 | 5 | 279 | 5 | 352 | 5 |
| Second | 290 | 5 | 376 | 5 | 430 | 5 | 499 | 5 |
| Third | 380 | 5 | 474 | 5 | 562 | 5 | 680 | 5 |
| Fourth | 480 | 5 | 598 | 5 | 715 | 4 | 842 | 3 |

| | Example 24 | | Example 25 | |
|---|---|---|---|---|
| | Wear area [μm²] | Rank | Wear area [μm²] | Rank |
| First | 180 | 5 | 225 | 5 |
| Second | 274 | 5 | 345 | 4 |
| Third | 362 | 4 | 456 | 3 |
| Fourth | 440 | 3 | 540 | 2 |

As can be seen from FIG. 13, the cleaning blades made of materials of Examples 24 and 25 and not having the backup layer was ranked lower at small wear areas than the cleaning blades made of materials of Examples 9, 11, 15, 18 and 20-23 and having the backup layer. The cleaning blades made of the materials of the Example 24 and 25 and not having the backup layers cannot maintain the pressure to remove foreign substances such as the toner and the external additives from the photoconductor surface because of the low rubber properties at the low temperature. Therefore, the toner slipped between the cleaning blade and the photoconductor when the wear area was small, and a rank of the cleaning performance lowered. On the other hand, the cleaning blade made of the materials of Examples 9, 11, 15, 18 and 20 to 23 and including the backup layer having the tan δ peak temperature of 0° C. or less and lower than that of the edge layer did not lower its rubber properties even under the low temperature and was appropriately able to maintain the pressure and the good cleaning performance even in large wear areas.

Also, as can be seen from Table 3, the good cleaning performance under the low temperature environment was able to be obtained when the tan δ peak temperature of the edge layer is from 12.5° C. to 18.8° C., and the tan δ peak temperature of the backup layer is −3.4° C. and −3.6° C. Also, as can be seen from Table 3, the good cleaning performance under the low temperature environment was able to be obtained by setting the tan δ peak temperature of the backup layer lower than the tan δ peak temperature of the edge layer by 15.9° C. or more.

In addition, as apparent from the comparison of Example 11 with Example 21, Example 15 with Example 22 and Example 18 with Example 23, the cleaning blade including the backup layer B2 had better cleaning performance under the low temperature environment than the cleaning blade including the backup layer B1. This illustrates that setting the rebound resilience of the backup layer at 10° C. higher than the rebound resilience of the edge layer at 10° C. improves the cleaning performance under the low temperature environment. In particular, Example 23 illustrates that setting the rebound resilience of the backup layer at 10° C. higher than the rebound resilience of the edge layer at 10° C. by 1% or more improves the cleaning performance under the low temperature environment. Example 20 illustrates that setting the rebound resilience of the backup layer at 10° C. higher than the rebound resilience of the edge layer at 10° C. by 12.5% improves the cleaning performance under the low temperature environment. Therefore, setting the rebound resilience of the backup layer at 10° C. higher than the rebound resilience of the edge layer at 10° C. by 1% or more and 12.5% or less certainly improves the cleaning performance under the low temperature environment. Additionally, conceivably setting the rebound resilience of the backup layer at 10° C. higher than the rebound resilience of the edge layer at 10° C. by 12.5% or more improves the cleaning performance under the low temperature environment.

The second evaluation test illustrates that the cleaning performance under the low temperature environment can be improved when the material of the edge layer is selected to have the low rebound resilience based on the wear resistance and the mirror-surface wear even if the tan δ peak temperature is high, and when the material of the edge layer is selected to have the tan δ peak temperature lower than the tan δ peak temperature of the material of the edge layer and the rebound resilience at the low temperature 10° C. greater than the rebound resilience at the low temperature 10° C. of the material of the edge layer.

In addition, Table 4 illustrates that the wear area of Examples 9, 11, 20 and 21 in which the 100% modulus value of the edge layer at 35° C. is smaller than the 100% modulus value of the backup layer at 35° C. was smaller than the wear area of Examples 15, 18, 22 and 23 in which the 100% modulus value at 35° C. was larger than the 100% modulus value at 35° C. of the backup layer.

Next, a second embodiment of the present disclosure is described.

The progress of the wear of the cleaning blade 15*a* directly deteriorates the cleaning performance of the toner. The deterioration of the cleaning performance under the low temperature environment is most noticeable. As described later, the wear of the cleaning blade affects the property stemming toner.

The wear amount of the edge portion of the cleaning blade 15*a* and the wear surface depends on ease of occurrence of the stick-slip. The stick-slip is a phenomenon in which the edge portion of the blade member 15*a*1 contacting the photoconductor 11 repeatedly changes between an original state and an elastically deformed state by the frictional force between the edge portion and the photoconductor 11. The occurrence of the vibration due to the stick-slip reduces the force to stem the toner, and the frictional force in the vibration wears the edge portion of the cleaning blade unevenly.

Such a state of the cleaning blade that is roughly worn is called fatigue wear. The fatigue wear causes disadvantages, in addition to the acceleration of the wear rate, for example, increase of the amount of toner slipping between the cleaning blade and the photoconductor property due to the uneven surface of the edge portion of the cleaning blade. Conceivably setting characteristic values of the cleaning blade such as hardness, rebound resilience, and tear strength improves the cleaning performance. For example, setting the hardness value of the rubber at more than or equal to a predetermined value reduce the wear, and setting the rebound resilience value at less than or equal to a predetermined value prevents occurrence of the stick-slip and abnormal sounds due to the vibration.

Reducing the vibration due to the stick-slip results in stabilization of the tip behavior of the cleaning blade and the smooth wear surface of the edge portion of the cleaning blade, which is called the mirror-surface wear. Such a stable wear surface improves sealing between the cleaning blade

15*a* and the photoconductor 11 and, in addition to reduction of the amount of toner slipping between the cleaning blade and the photoconductor, can reduce the wear rate caused by the frictional vibration.

However, the hardness and the rebound resilience have an interaction. That is, the proper condition range of the one characteristic value to provide the cleaning blade with the required performance differs depending on the conditions of the other characteristic values. For example, the wear of the cleaning blade depends on an amplitude and a strength of the stick-slip, and the stick-slip is more likely to occur in the cleaning blade having higher hardness or higher rebound resilience. That is, even with the same rebound resilience, the stick-slip is less likely to occur (that is, less likely to be worn) in the cleaning blade made of a low hardness material than a high hardness material. In the characteristic values having the interaction, definition of the characteristic values defined by a relation is more preferable than definition of the characteristic values independently and respectively defined to select a material having a desired performance. For example, when desired hardness and desired rebound resilience are independently defined as the hardness from A to B and the rebound resilience from C to D, and the condition A and C satisfies the desired performance, the interaction may cause the case that the condition A and D does not satisfy the desired performance. Therefore, as for the hardness and the rebound resilience that have the interaction, the definition by the relation that defines the hardness and the rebound resilience enables more suitable selection of materials. In the present embodiment, an evaluation test described later provides the relation of the hardness and the rebound resilience of the cleaning blade that attains good cleaning performance even after printing 400,000 sheets. The relation enables selection of materials for the blade member 15*a*1 that attains good cleaning performance over time and the selection from wider range of characteristic values.

On the other hand, a temperature in the image forming apparatus body during printing may shift the rebound resilience that highly depends on the temperature and is different temperature characteristic in each material from a suitable value that is effective to prevent the above-described disadvantage, that is, the fatigue wear. Recently, toner having lower melting point is widely used to shorten the start-up time and save power. Softening points of such toner are about 45 to 55° C., and the fixing temperature of the fixing device 20 is 140 to 170° C. To prevent the toner from aggregating and concreting, a configuration of the photoconductor cleaning devices 15 and the structure near the photoconductor cleaning devices 15 is designed and arranged so that temperatures are from 30° C. to 40° C. that are equal to or lower than the above-described softening point of the toner. Basically, the temperatures that are equal to or lower than the softening point of the toner do not cause problems. Complete shielding from heat generated by the fixing device 20 and the developing devices 13 is difficult, and the temperature rise of 10 to 20° C. is inevitable with respect to the ambient temperature, that is, an environmental temperature.

Therefore, the selection of materials based on the rebound resilience at the room temperature (23° C. to 25° C.) in the general office is not suitable for practical use, and desired characteristics cannot be obtained. That is, the temperature in the image forming apparatus body higher than 25° C. shifts the rebound resilience of the cleaning blade from a target range of the rebound resilience that is set based on the room temperature (23° C. to 25° C.) in the general office, increases the vibration of the cleaning blade, accelerates the wear of the cleaning blade, deteriorates the cleaning performance, and, as a result, shortens the life of the cleaning blade.

Therefore, in the present embodiment, the target range of the rebound resilience is set based on the rebound resilience in 35° C. that is the real temperature in the image forming apparatus body during printing.

An evaluation test performed by the present inventors is described below. Using the cleaning blades of examples 1 to 10 and comparative examples 1 to 10 that include the blade members having the two-layer structures each including the backup layer 115*b* and the edge layer 151*a* as illustrated in FIG. 4, the present inventors performed the evaluation test. The blade member 15*a*1 of each cleaning blade was adhered and fixed to an L-shaped metal blade holder 15*a*2. The edge layer 151*a* had the layer thickness of 0.5 mm, and the backup layer 151*b* had the layer thickness of 1.5 mm. Table 5 illustrates characteristic values of the edge layers in the cleaning blades 15*a* of the examples 1 to 10 and the comparative examples 1 to 10. The edge layers were made of different materials from the backup layers and had different hardness from the backup layers.

TABLE 5

| | | Example 1 | Example 2 | Example 3 | Example 4 | Example 5 |
|---|---|---|---|---|---|---|
| Hardness (JIS A) | | 64 | 65 | 66 | 68 | 69 |
| Rebound resilience [%] | 10° C. | 11 | 7 | 11 | 16 | 16 |
| | 23° C. | 12 | 12 | 8 | 10 | 9 |
| | 35° C. | 29 | 29 | 22.5 | 16 | 21 |
| | | **Example 6** | **Example 7** | **Example 8** | **Example 9** | **Example 10** |
| Hardness (JIS A) | | 69 | 71 | 72 | 74 | 76 |
| Rebound resilience [%] | 10° C. | 21 | 23 | 20 | 29 | 34 |
| | 23° C. | 10 | 10 | 11 | 13 | 16 |
| | 35° C. | 13 | 13 | 14 | 10 | 9.5 |
| | | **Comparative Example 1** | **Comparative Example 2** | **Comparative Example 3** | **Comparative Example 4** | **Comparative Example 5** |
| Hardness (JIS A) | | 64 | 68 | 69 | 71 | 72 |
| Rebound resilience [%] | 10° C. | 9 | 6 | 16 | 9.5 | 10.5 |
| | 23° C. | 14 | 22 | 25 | 27 | 22.5 |
| | 35° C. | 37 | 45 | 36 | 45.5 | 41.5 |
| | | **Comparative Example 6** | **Comparative Example 7** | **Comparative Example 8** | **Comparative Example 9** | **Comparative Example 10** |
| Hardness (JIS A) | | 72 | 72 | 73 | 76 | 80 |
| Rebound resilience [%] | 10° C. | 11 | 10 | 16.5 | 11.5 | 14 |
| | 23° C. | 22 | 13 | 44.5 | 21 | 34 |
| | 35° C. | 38 | 25 | 65.5 | 39 | 43 |

The material of the backup layers was common to Examples 1 to 10 and Comparative Examples 1 to 10. Table 6 illustrates the characteristic values of the backup layer.

TABLE 6

| | | Physical Properties of Backup layer |
|---|---|---|
| Hardness (JIS A) | | 73 |
| Rebound resilience [%] | 10° C. | 16.5 |
| | 23° C. | 44.5 |
| | 35° C. | 65.5 |

The hardness and the rebound resilience of the cleaning blades prepared in Examples 1 to 10 and Comparative Examples 1 to 10 was appropriately changed to select the most suitable material for a system. The hardness of each cleaning blade was measured using a JIS-A type hardness tester according to the measurement method described in JIS-K6301. The rebound resilience values were measured by a resilience measurement instrument No. 221 manufactured by Toyo Seiki Seisaku-sho, Ltd. according to JIS-K6255 at each of temperatures in Table 6.

Figure 14:
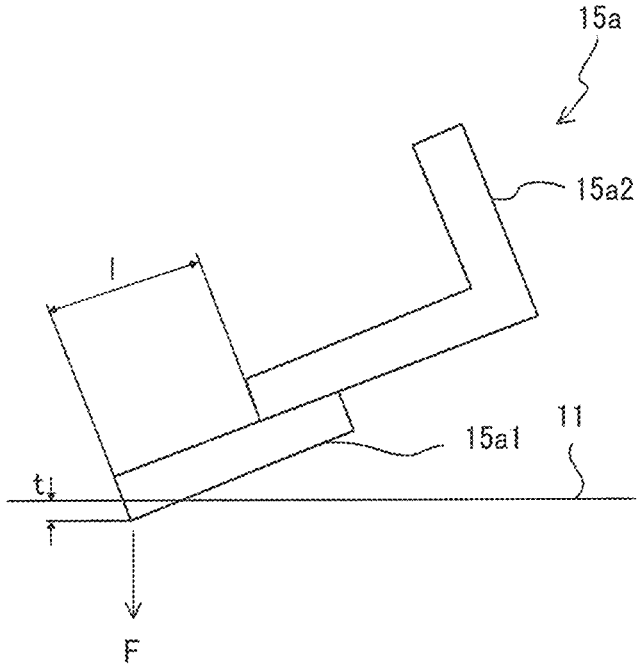
FIG. 14 is an explanatory diagram illustrating a condition of the cleaning blade evaluated in a second embodiment.

FIG. 14 is an explanatory diagram illustrating the condition of the cleaning blade evaluated in the evaluation test. As illustrated in FIG. 14, free lengths l of rubber materials of cleaning blades made in the Examples 1 to 10 and the comparative examples 1 to 10 were adjusted so that the contact pressures F with respect to the photoconductors 11 were 20 N/m and compression amounts t were 1 mm. The compression amount t is a gap t between the surface of the photoconductor 11 and the tip of the cleaning blade assumed that there is not photoconductor 11 as illustrated in FIG. 14.

<A Printing Operation to Wear the Cleaning Blade>

A printing operation to wear the cleaning blade was performed under the following conditions to evaluate the wear area S of the cleaning blade and the wear surface of the cleaning blade.

- The image forming apparatus used in the printing operation: MPC5100S manufactured by Ricoh Co., Ltd.
- A running chart used in the printing operation: image area rate of 5% and A4 size (the printing operation was performed so that the longer side of A4 sheet was parallel to the photoconductor axis).
- A number of printed sheets in the printing operation: 400,000 sheets Before the printing operation, the amount of the lubricants to be applied (supplied) to the photoconductor 11 was adjusted so that the friction coefficient between the photoconductor 11 and the cleaning blade 15*a* was 0.2 or less.

<Evaluation of Wear Area S>

Figure 5:
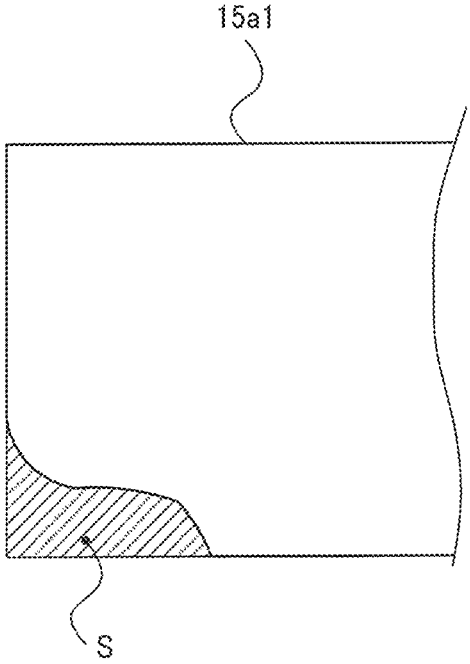
FIG. 5 is an explanatory diagram illustrating a wear area.

The wear area S is the cross-sectional area of the portion lost from the initial state by the printing operation, as illustrated in the hatched portion in FIG. 5. The ware area S $m^2$ was determined by observing a three-dimensional image of the tip of the cleaning blade after the printing operation with the laser microscope VK-9500 manufactured by KEYENCE.

After the printing operation described above, the inventors performed following Evaluations 1 to 4 to evaluate the cleaning blade:

<Evaluation of Wear Surface>

To evaluate the ware surface of the cleaning blade after the printing operation, the laser microscope VK-100 manufactured by KEYENCE was used, and the wear surface was observed in a direction illustrated by a straight arrow in FIG. 6. The lens magnification was 100 times. The fatigue wear was defined as the wear surface on which large unevenness was observed, as illustrated in FIG. 7A. The mirror-surface wear was defined as the smooth ware surface on which unevenness was not observed, as illustrated in FIG. 7B. The intermediate wear was defined as the intermediate wear surface between the mirror-surface wear and the fatigue wear, as illustrated in FIG. 7C.

<Evaluation of Cleaning Performance Under Low Temperature Environment>

Cleaning performance under low temperature environment was evaluated after printing under the following conditions.

Evaluation environment: 10° C. and 15% RH

- The image forming apparatus used in the evaluation: MPC5100S manufactured by Ricoh Co., Ltd.
- The cleaning blade used in the evaluation: the cleaning blade used in the printing operation described above. In the printing operation, the image forming apparatus printed 400,000 sheets.
- A running chart used in the evaluation: a running chart illustrated in FIG. 8, including vertical solid band in the A4 size (printing was performed so that the longer side of A4 sheet was parallel to the photoconductor axis)
- A number of printed sheets in the evaluation 4: 1,000 sheets.

The cleaning performance under the low temperature environment was evaluated based on the output images in the above-described printing under the low temperature environment. When the abnormal image due to the cleaning failure was found in the output images, the cleaning performance under the low temperature environment was evaluated as poor. When the abnormal image due to the cleaning failure that is uneven image density or streaks was not found in the output images, the cleaning performance under the low temperature environment was evaluated as good.

<Evaluation of the Amount of the Toner Slipping Between the Cleaning Blade and the Photoconductor>

The amount of toner adhering to the lubricant supply roller 16*a* was evaluated after printing under the following conditions. Hereinafter, this printing is referred to as a slipping toner running test.

- The image forming apparatus used in the evaluation: MPC5100S manufactured by Ricoh Co., Ltd.
- The cleaning blade used in the evaluation: the cleaning blade used in the printing operation described above. In the printing operation, the image forming apparatus printed 400,000 sheets.
- A running chart used in the evaluation: The running chart including vertical solid band in the A4 size (see FIG. 8, printing was performed so that the longer side of A4 sheet was parallel to the photoconductor axis).
- A number of printed sheets in the evaluation: 1,000 sheets.

A scanner read a surface of the new lubricant supply roller 16*a* as illustrated in FIG. 1 OA before slipping toner running test and measured a brightness value L0. After slipping toner running test, the scanner read the surface of the lubricant supply roller 16*a* as illustrated in FIG. 10B and measured a brightness value L1. Next, the difference of the brightness values, $\Delta L(=L0-L1)$, before and after the slipping toner running test described above was obtained. That is, a decrease in the brightness value of the lubricant supply roller 16*a* due to the toner slipping between the cleaning blade and the photoconductor was a substitute characteristic of the amount of toner slipping between the cleaning blade and the photoconductor. When $\Delta L>50$, the amount of the toner slipping between the cleaning blade and the photoconductor was evaluated as unacceptable, which is illustrated as "Poor" in Table 7, and when $\Delta L\leq 50$, the amount of the toner slipping between the cleaning blade and the photoconductor was evaluated as acceptable, which is illustrated as "Good" in Table 7.

Figure 15:
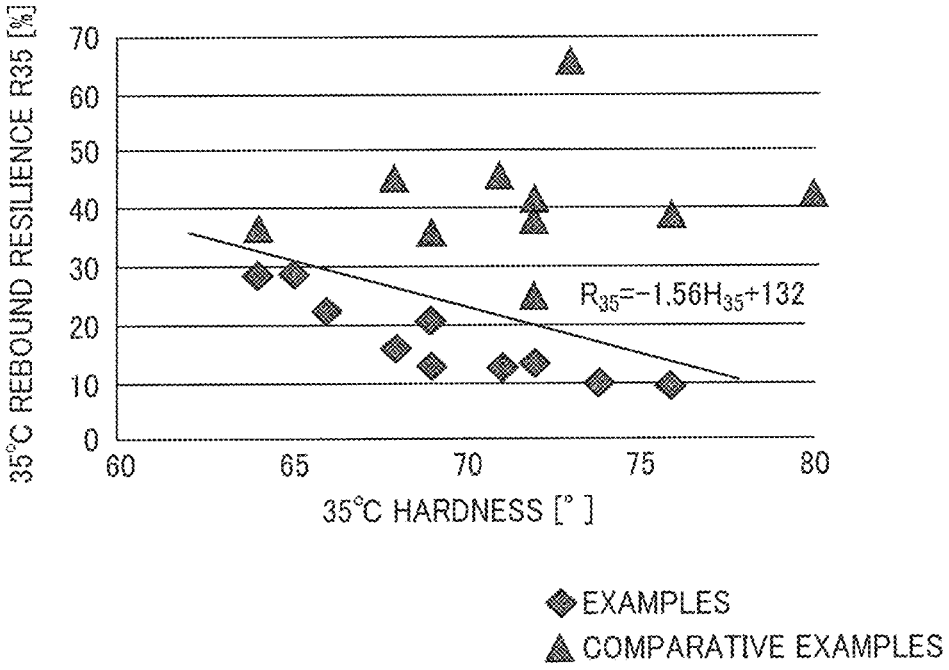
FIG. 15 is a graph illustrating a relation between rebound resilience at 35° C. and hardness at 35° C. in Examples 1 to 10 and Comparative Examples 1 to 10 in the second embodiment.

Table 7 below lists the results of the evaluations in Example 1 to 10 and Comparative example 1 to 10. FIG. 15 is a graph illustrating a relation between the rebound resilience values at 35° C. and Asker A hardness values at 35° C. in Examples 1 to 10 and Comparative Examples 1 to 10.

TABLE 7

| | Example 1 | Example 2 | Example 3 | Example 4 | Example 5 |
|---|---|---|---|---|---|
| Wear area [$\mu m^2$] | 350 | 340 | 350 | 400 | 420 |
| Wear surface | Intermediate wear | Intermediate wear | Mirror-surface | Mirror-surface | Mirror-surface |
| Cleaning performance under low temperature | Good | Good | Good | Good | Good |
| Amount of the toner slipping between the cleaning blade and the photoconductor | Good | Good | Good | Good | Good |

| | Example 6 | Example 7 | Example 8 | Example 9 | Example 10 |
|---|---|---|---|---|---|
| Wear area [$\mu m^2$] | 520 | 490 | 550 | 600 | 640 |
| Wear surface | Mirror-surface | Mirror-surface | Mirror-surface | Mirror-surface | Intermediate wear |
| Cleaning performance under low temperature | Good | Good | Good | Good | Good |
| Amount of the toner slipping between the cleaning blade and the photoconductor | Good | Good | Good | Good | Good |

| | Comparative Example 1 | Comparative Example 2 | Comparative Example 3 | Comparative Example 4 | Comparative Example 5 |
|---|---|---|---|---|---|
| Wear area [$\mu m^2$] | 630 | 820 | 800 | 990 | 1090 |
| Wear surface | Fatigue wear | Fatigue wear | Fatigue wear | Fatigue wear | Fatigue wear |
| Cleaning performance under low temperature | Good | Poor | Good | Good | Poor |
| Amount of the toner slipping between the cleaning blade and the photoconductor | Poor | Poor | Poor | Poor | Poor |

| | Comparative Example 6 | Comparative Example 7 | Comparative Example 8 | Comparative Example 9 | Comparative Example 10 |
|---|---|---|---|---|---|
| Wear area [$\mu m^2$] | 1030 | 1020 | 980 | 1050 | 1200 |
| Wear surface | Fatigue wear | Fatigue wear | Fatigue wear | Fatigue wear | Fatigue wear |
| Cleaning performance under low temperature | Poor | Poor | Good | Poor | Poor |
| Amount of the toner slipping between the cleaning blade and the photoconductor | Poor | Poor | Poor | Poor | Poor |

The wear areas after printing 400,000 sheets in Example 1 to 10 was smaller than that in Comparative Examples 1 to 10, and the cleaning performance under the low temperature environment after printing 400,000 and the amount of the toner slipping between the cleaning blade and the photoconductor were acceptable. In addition, while the wear surfaces in Examples 1 to 10 were the mirror surface wear or the intermediate wear, all of the wear surfaces in Comparative Examples 1 to 10 were the fatigue wear, and the amount of the toner slipping between the cleaning blade and the photoconductor in Comparative Examples 1 to 10 were all unacceptable, "Poor".

Conceivably, in Comparative examples 1 to 10, increase in the wear area causes increase in a contact width between the cleaning blade and the photoconductor 11 and decrease in the contact pressure. In addition, since each of the wear surfaces in Comparative examples 1 to 10 were the fatigue wear that means severe unevenness formed on the wear surface, conceivably a gap is generated between the photoconductor 11 and the cleaning blade. Conceivably the decrease in the contact pressure and the generated gap interrupts the cleaning blade from damming residual toner after transfer and increase the amount of the toner slipping between the cleaning blade and the photoconductor, and, as a result, the amount of the toner slipping between the cleaning blade and the photoconductor in all of Comparative examples 1 to 10 were unacceptable, "Poor".

In contrast, in Examples 1 to 10, the amount of the toner slipping between the cleaning blade and the photoconductor 11 was acceptable after printing 400,000 sheets because conceivably less wear prevented the increase in the contact width between the cleaning blade and the photoconductor 11 and the decrease in the contact pressure. In addition, since the wear surfaces in Examples 1 to 10 were the intermediate wear and the mirror-wear, conceivably the sealing between the cleaning blade 15*a* and the photoconductor 11 was maintained. Therefore, conceivably the cleaning blades in Examples 1 to 10 after printing 400,000 sheets were able to favorably dam the residual toner after transfer, and the amounts of the toner slipping between the cleaning blade and the photoconductor were acceptable.

In addition, one of factors that enable the amount of the toner slipping between the cleaning blade 15*a* and the photoconductor 11 to be acceptable after printing 400,000 sheets is considered applying the lubricant to the photoconductor 11 and leading the friction coefficient between the photoconductor 11 and the cleaning blade 15*a* to 0.2 or less, which can prevent occurrence of the stick-slip and reduce the wear of the cleaning blade 15*a*.

As illustrated in FIG. 15, in a relation between the Asker A hardness values at 35° C. and the rebound resilience values at 35° C., a boundary line can be drawn between Examples 1 to 10 in which the amount of the toner slipping between the cleaning blade and the photoconductor were acceptable that are diamonds in FIG. 15 and Comparative examples 1 to 10 in which the amount of the toner slipping between the cleaning blade and the photoconductor were unacceptable that are triangles in FIG. 15. This boundary line can be expressed as R35=−1.56H35+132, where R35 is the rebound resilience values R35 at temperature 35° C., and H35 is the Asker A hardness values H35 at temperature 35° C.

That is, FIG. 15 illustrates that satisfying the relation R35=−1.56H35+132 that is the relation between rebound resilience values at 35° C. and the Asker A hardness values at 35° C. can reduce the stick-slip movement, prevent occurrence of the fatigue wear, slow progress of the wear, and maintain the good cleaning performance even after printing 400,000 sheets. Therefore, the cleaning blade can be applied to a long-life unit in recent years.

Definition by the above-described relation, R35=−1.56H35+132 of the hardness and the rebound resilience that have the interaction enables simple selection of an appropriate material of the edge layer. Since 35° C. is the real temperature in the image forming apparatus body during printing, the definition of the relation between the Asker A hardness values at 35° C. and the rebound resilience values at 35° C. in the present embodiment can avoid shift of the rebound resilience of the cleaning blade from the target range in the actual use, increase of the vibration of the cleaning blade, acceleration of the wear of the cleaning blade, and degradation of the cleaning performance.

Moreover, although the wear area in Comparative example 2 was smaller than the one in Comparative example 4 and 8, the cleaning performance under the low temperature environment was poor that is "Poor" in Table 7. Referring to Table 5, the rebound resilience value at 10° C. in Comparative Example 2 was 6%. On the other hand, in all of Examples 1 to 10 and Comparative Examples 1, 3, 4 and 8 having the good cleaning performance under the low temperature environment that is described as "Good" in Table 7, rebound resilience values at 10° C. were 7% or more. Conceivably too low rebound resilience value led to the poor cleaning performance under the low temperature environment that is described as "Poor" in Table 7. This illustrates that setting the rebound resilience value at 10° C. to 7% or more improves the cleaning performance under the low temperature environment.

Although the two-layer cleaning blades were used in the above-described embodiment, a single-layer cleaning blade has similar advantages if the above-described conditions are satisfied. In addition, if at least the edge portion of the edge layer satisfies the above-mentioned conditions, a blade having three or more layers has similar advantages descried above.

The embodiments described above are one example and attain advantages below in a plurality of aspects 1 to 20.

First Aspect

In the first aspect, a cleaning blade such as the cleaning blade 15*a* includes an edge portion such as the edge portion of the blade member 15*a*1 made of elastic material having the rebound resilience value R35 at 35° C. and the 100% modulus value M35 at 35° C. that satisfy the following relation (A):

$$R35 \leq -4.8M35+42. \quad (A)$$

As described in the evaluation tests above, setting the relation between the rebound resilience value R35 at 35° C. and the 100% modulus value M35 at 35° C. to R35≤−4.8 M35+42 can improve the wear resistance and maintain the good cleaning performance even after an object to be cleaned such as the photoconductor travels 200 km. Therefore, this enables the life of the cleaning blade to be longer.

Second Aspect

In the second aspect, the elastic material in the first aspect has a rebound resilience value R35 at 35° C. and a 100% modulus value M35 at 35° C. that satisfy the following relation (B):

$$R35=-4.3M35+31. \quad (B)$$

As described in the first evaluation test, satisfying the relation (B) can further improve the wear resistance.

Third Aspect

In the third aspect, the cleaning blade according to the first aspect includes an edge layer such as the edge layer 151*a* including the edge portion; and a backup layer such as the backup layer 151*b* layered on the edge layer.

As described in the second evaluation test and the like, the material of the backup layer can improve the cleaning performance under the low temperature environment and widen the choice of the edge layer.

Fourth Aspect

In the fourth aspect, the tan δ peak temperature of the backup layer such as the backup layer 15*b* of the cleaning blade according to the third aspect is lower than the tan δ peak temperature of the edge layer such as the edge layer 151*a*.

As described in the second evaluation test, even if the tan δ peak temperature of the edge layer is high, this can prevent the rubber property of the cleaning blade 15*a* under the low temperature (10° C.) environment from deteriorating. This can prevent the contact pressure from the cleaning blade to the photoconductor under the low temperature environment from decreasing and maintain the cleaning performance under the low temperature environment even if the wear progresses. In addition, this allows using a material having a high tan δ peak temperature for the edge layer and broaden the range of selection of the material for the edge layer.

Fifth Aspect

In the fifth aspect, the tan δ peak temperature of the material of the backup layer such as the backup layer 115*b* in the cleaning blade according to the fourth aspect is 0° C. or less. As described in the second evaluation test, even if the tan δ peak temperature of the edge layer is high, this can prevent the rubber property of the cleaning blade 15*a* under the low temperature (10° C.) environment from deteriorating. Therefore, the cleaning blade can maintain the cleaning performance under the low temperature environment even if the wear progresses. In addition, this enables the cleaning blade to maintain the good cleaning performance under the low temperature environment after the wear progresses even if the tan δ peak temperature of the edge layer is higher than the low temperature 10° C. by about 10 degrees and broaden the range of selection in the material for the edge layer.

Sixth Aspect

In the sixth aspect, the rebound resilience value at 10° C. of the backup layer of the cleaning blade according to the third aspect is greater than the rebound resilience value at 10° C. of the edge layer.

As described in the second evaluation test, the cleaning blade having the rebound resilience value at 10° C. of the backup layer greater than the rebound resilience value at 10° C. of the edge layer can have better cleaning performance under the low temperature environment than the cleaning blade having the rebound resilience value at 10° C. of the backup layer smaller than or equal to the rebound resilience value at 10° C. of the edge layer.

Seventh Aspect

In the seventh aspect, the 100% modulus value at 35° C. of the material in the edge layer of the cleaning blade according to the third aspect is smaller than the 100% modulus value at 35° C. of the material in the backup layer.

As described in Examples 20 and 21 in the evaluation test, this can attain the good cleaning performance under the low temperature environment.

Eighth Aspect

In the eighth aspect, the 100% modulus value at 35° C. of the material in the edge layer of the cleaning blade according to the seventh aspect is 6.3 MPa or less.

As apparent from Table 2 of the first evaluation test, the cleaning blades of Examples 1 to 19 in which the 100% modulus value of the edge layer at 35° C. is 6.3 MPa or less had good wear resistance. Therefore, setting the 100% modulus value at 35° C. of the edge layer to 6.3 MPa or less can make the cleaning blade having better wear resistance.

Ninth Aspect

In the ninth aspect, an image forming apparatus such as the image forming apparatus 1 includes an image bearer such as the photoconductor 11 and the cleaning blade such as the cleaning blade 15*a* according to the first aspect to remove the substances such as the toner and the external additives on the image bearer.

This allows maintaining good images over time.

Tenth Aspect

In the tenth aspect, the image forming apparatus according to the ninth aspect further includes a lubricant applying device such as the lubricant applying device 16 to apply lubricants to a surface of the image bearer such as the photoconductor 11.

As described in the embodiments, applying the lubricants onto the surface of the image bearer can reduce friction coefficient between the photoconductor and the cleaning blade and improve the wear resistance of the cleaning blade.

Eleventh Aspect

In the eleventh aspect, a process cartridge such as the image forming unit 10 includes an image bearer such as the photoconductor 11 and the cleaning blade such as the cleaning blade 15*a* according to the first aspect to remove the substances such as the toner and the external additives on the image bearer.

This allows maintaining good images over time and extending the life of the process cartridge.

Twelfth Aspect

In the twelfth aspect, the process cartridge according to the eleventh aspect further includes a lubricant applying device such as the lubricant applying device 16 to apply lubricant to a surface of the image bearer such as the photoconductor 11.

As described in the embodiments, applying the lubricants onto the surface of the image bearer can reduce friction coefficient between the photoconductor and the cleaning blade and improve the wear resistance of the cleaning blade.

Thirteenth Aspect

In the thirteenth aspect, a cleaning blade such as the cleaning blade 15*a* includes an edge portion such as the edge portion of the blade member 15*a*1 made of elastic material having a rebound resilience value R35 at 35° C. and a JIS Asker A hardness value H35 at 35° C. that satisfy the following relation (C).

$$R35 \leq -1.56 \times H35 + 132. \quad \text{(C)}$$

In the thirteenth aspect, as apparent from the above-described evaluation test, setting the relation between the JIS Asker A hardness value H35 at 35° C. and the rebound resilience value R35 at 35° C. of a material of an edge portion to satisfy $R35 \leq -1.56 \times H35 + 132$ can reduce the amount of the toner slipping between the cleaning blade and the photoconductor and obtain good cleaning performance even after printing 400,000 sheets.

Fourteenth Aspect

In the fourteenth aspect, the cleaning blade according to the thirteenth aspect includes the edge portion such as the edge portion of the edge layer 151*a* made of the elastic material having the JIS Asker A hardness H35 at 35° C. is 64 degrees or more and 76 degrees or less.

As seen from Tables 4 to 6, the cleaning blade including the edge portion of the edge layer 151*a* made of the elastic material having the JIS Asker A hardness H35 at 35° C. from 64 degrees to 76 degrees can reduce the amount of the toner slipping between the cleaning blade and the photoconductor and obtain good cleaning performance even after printing 400,000 sheets.

Fifteenth Aspect

In the fifteenth aspect, the cleaning blade according to the thirteenth aspect includes the edge portion such as the edge portion of the edge layer 151*a* made of the elastic material having a rebound resilience at 10° C. that is 7% or more.

As described in the evaluation tests, the cleaning blade according to the fifteenth aspect can maintain the good cleaning performance under the low temperature environment even after printing 400,000 sheets.

Sixteenth Aspect

In the sixteenth aspect, the cleaning blade according to the thirteenth aspect includes the edge portion made of the elastic material that is rubber.

This allows obtaining the blade member made of the elastic material.

Seventeenth Aspect

In the seventeenth aspect, the cleaning blade according to the thirteenth aspect further includes a layer such as the edge layer 151*a* including the edge portion and another layer such as the backup layer 115*b* layered on the layer, and the another layer includes a material different from a material of the layer. That is, the blade member 15*a*1 has the laminated layer structure including layers of more than two types of materials.

The laminated structure can increase the freedom of material selection and configure a cleaning blade more suitable for the system.

Eighteenth Aspect

In the eighteenth aspect, a cleaning device such us the photoconductor cleaning device 15 includes the cleaning blade such as the cleaning blade 15*a* according to the thirteenth aspect.

As described in the embodiment, the cleaning device according to the eighteenth aspect can maintain good cleaning performance for a long time.

Nineteenth Aspect

In the nineteenth aspect, an image forming apparatus includes an image bearer such as the photoconductor 11 and the cleaning blade such as the cleaning blade 15*a* according to the thirteenth aspect to remove the substances such as the toner and the external additives on the image bearer.

As described in the embodiments, the image forming apparatus according to the nineteenth aspect can obtain good images without defective images such as the image with the uneven image density or the streak over time.

Twentieth Aspect

In the twentieth aspect, the image forming apparatus according to the nineteenth aspect includes an image bearer such as the photoconductor 11 and the cleaning blade such as the cleaning blade 15*a*, and the friction coefficient between the image bearer and the cleaning blade is 0.2 or less.

The image forming apparatus according to the twentieth aspect can reduce the stick slip and the wear of the cleaning blade 15*a* and maintain good cleaning performance for a long time.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A cleaning blade comprising an edge portion made of an elastic material having a rebound resilience value R35 at 35° C. and a 100% modulus value M35 at 35° C. that satisfy a relation:

$$R35 \leq -4.8M35+42.$$

2. The cleaning blade according to claim 1, wherein the rebound resilience value R35 at 35° C. and the 100% modulus value M35 at 35° C. of the elastic material satisfy a relation:

$$R35=-4.3M35+31.$$

3. The cleaning blade according to claim 1, further comprising:

an edge layer including the edge portion; and a backup layer layered on the edge layer.

4. The cleaning blade according to claim 3, wherein a tan δ peak temperature of a material of the backup layer is lower than a tan δ peak temperature of a material of the edge layer.

5. The cleaning blade according to claim 4, wherein the tan δ peak temperature of the material of the backup layer is 0° C. or less.

6. The cleaning blade according to claim 3, wherein a rebound resilience value at 10° C. of a material of the backup layer is greater than a rebound resilience value at 10° C. of a material of the edge layer.

7. The cleaning blade according to claim 3, wherein a 100% modulus value at 35° C. of a material of the edge layer is smaller than a 100% modulus value at 35° C. of a material of the backup layer.

8. The cleaning blade according to claim 7, wherein the 100% modulus value at 35° C. of the material of the edge layer is 6.3 MPa or less.

9. An image forming apparatus, comprising:

an image bearer; and the cleaning blade according to claim 1 to remove a substance on the image bearer.

10. The image forming apparatus according to claim 9, further comprising a lubricant applying device to apply lubricant to a surface of the image bearer.

11. A process cartridge comprising:

an image bearer; and the cleaning blade according to claim 1 to remove a substance on the image bearer.

12. The process cartridge according to claim 11, further comprising:

a lubricant applying device to apply lubricant to a surface of the image bearer.

13. A cleaning blade comprising:

an edge portion made of an elastic material having a rebound resilience value R35 at 35° C. and a JIS Asker A hardness value H35 at 35° C. that satisfy a relation:

$$R35 \leq -1.56 \times H35+132.$$

14. The cleaning blade according to claim 13, wherein the JIS Asker A hardness value H35 at 35° C. is 64 degrees or more and 76 degrees or less.

15. The cleaning blade according to claim 13, wherein a rebound resilience at 10° C. of the elastic material of the edge portion is 7% or more.

16. The cleaning blade according to claim 13, wherein the elastic material of the edge portion is rubber.

17. The cleaning blade according to claim 13, further comprising a first layer including the edge portion; and a second layer layered on the first layer, the first layer and the second layer being made of different materials.

18. A cleaning device comprising the cleaning blade according to claim 13.

19. An image forming apparatus comprising:

an image bearer; and the cleaning blade according to claim 13 to remove a substance on the image bearer.

20. The image forming apparatus according to claim 19, wherein a friction coefficient between the image bearer and the cleaning blade is 0.2 or less.

* * * * *